US010363764B2

(12) United States Patent
Makley et al.

(10) Patent No.: US 10,363,764 B2
(45) Date of Patent: Jul. 30, 2019

(54) PORTABLE PRINTER AND METHODS

(71) Applicant: Avery Dennison Corporation, Mentor, OH (US)

(72) Inventors: James A Makley, Springboro, OH (US); John D Mistyurik, Troy, OH (US); Larri B Williams, Dayton, OH (US)

(73) Assignee: AVERY DENNISON CORPORATION, Glendale, CA (US)

( * ) Notice: Subject to any disclaimer, the term of this patent is extended or adjusted under 35 U.S.C. 154(b) by 0 days.

(21) Appl. No.: 14/243,441

(22) Filed: Apr. 2, 2014

(65) Prior Publication Data

US 2014/0210936 A1 Jul. 31, 2014

Related U.S. Application Data

(62) Division of application No. 12/036,673, filed on Feb. 25, 2008, now Pat. No. 8,721,208.

(51) Int. Cl.

| | |
|---|---|
| ***B41J 3/36*** | (2006.01) |
| ***B41J 2/325*** | (2006.01) |
| ***B41J 32/00*** | (2006.01) |

(52) U.S. Cl.

CPC ..... *B41J 32/00* (2013.01); *B41J 2/325* (2013.01); *B41J 3/36* (2013.01)

(58) Field of Classification Search

CPC ..... B41J 32/00; B41J 3/36; B41J 3/00; B41J 35/04; B41J 2/325

See application file for complete search history.

(56) References Cited

U.S. PATENT DOCUMENTS

| | | | | |
|---|---|---|---|---|
| 4,209,261 | A * | 6/1980 | Bell et al. | 400/196.1 |
| 4,514,740 | A * | 4/1985 | Fujiwara et al. | 346/139 R |
| 5,158,380 | A * | 10/1992 | Hauslaib et al. | 400/605 |
| 5,160,205 | A | 11/1992 | Mistyurik | |
| 5,486,259 | A | 1/1996 | Goodwin et al. | |
| 5,516,219 | A * | 5/1996 | Leonard et al. | 400/613 |
| 5,570,121 | A | 10/1996 | Mistyurik et al. | |
| 5,588,756 | A | 12/1996 | Hamisch, Jr. et al. | |
| 5,597,249 | A | 1/1997 | Mistyurik | |
| 5,672,020 | A * | 9/1997 | Leonard | B41J 2/32 347/218 |
| 5,708,462 | A | 1/1998 | Hembold et al. | |
| 5,779,371 | A * | 7/1998 | Aoyama et al. | 400/120.16 |
| 5,785,442 | A | 7/1998 | Hamisch, Jr. et al. | |

(Continued)

FOREIGN PATENT DOCUMENTS

| | | |
|---|---|---|
| EP | 0648609 | 4/1995 |
| EP | 1084851 | 3/2001 |

(Continued)

OTHER PUBLICATIONS

European Search Report dated Sep. 19, 2012 for Application No. EP11000949.5.

*Primary Examiner* — David H Banh

(74) *Attorney, Agent, or Firm* — Avery Dennison Retail Information Services, LLC

(57) ABSTRACT

This is disclosed a portable printer that is easy to load with an ink ribbon cartridge and record members web supplies, that is simple, has relatively few parts, is lightweight and has a small footprint.

22 Claims, 37 Drawing Sheets

(56) References Cited

U.S. PATENT DOCUMENTS 6,036,155 A * 3/2000 Tsui ..... B60R 19/02 248/345.1
6,241,407 B1 6/2001 Huggins et al.
6,302,604 B1 * 10/2001 Bryant et al. ..... 400/619
6,336,757 B1 * 1/2002 Nishimura et al. ..... 400/613
6,431,492 B1 * 8/2002 Chillscyzn ..... 242/577
6,533,476 B2 3/2003 Hamisch, Jr. et al.
6,609,844 B1 8/2003 Petteruti et al.
8,231,289 B2 * 7/2012 Chen ..... 400/618
2002/0172537 A1 * 11/2002 Hamisch, Jr. ..... B41J 3/36 400/191
2004/0047667 A1 * 3/2004 Huggins ..... B41J 3/36 400/88
2004/0145717 A1 * 7/2004 Kobayashi ..... 355/133
2005/0036816 A1 * 2/2005 Carriere ..... B41J 15/044 400/578
2005/0036819 A1 * 2/2005 Monteith ..... B41J 3/4075 400/615.2
2005/0169690 A1 * 8/2005 Redman et al. ..... 400/615.2
2006/0024107 A1 * 2/2006 Lyman et al. ..... 400/88
2006/0096714 A1 * 5/2006 Chen ..... 156/574
2006/0104701 A1 * 5/2006 Myers ..... B41J 11/666 400/621
2006/0274493 A1 * 12/2006 Richardson ..... G06F 1/1626 361/679.4
2007/0201936 A1 * 8/2007 Nakashima ..... B41J 11/007 400/629
2008/0003038 A1 * 1/2008 Nihashi et al. ..... 400/188
2010/0119284 A1 * 5/2010 Vandermeulen ..... B41J 11/703 400/621

FOREIGN PATENT DOCUMENTS

JP 2002137513 5/2002
JP 2005324379 11/2005

* cited by examiner

PORTABLE PRINTER AND METHODS

REFERENCE TO RELATED APPLICATION

The present application is a division of U.S. Priority application Ser. No. 12/036,673 filed Feb. 25, 2008 which is incorporated herein by reference in its entirety.

BACKGROUND

Field

The disclosed embodiments relate to printers and methods of making printers.

Brief Description of the Prior Art

The following prior art is made of record: U.S. Pat. Nos. 5,160,205; 5,486,259; 5,570,121; 5,588,756; 5,708,462; 5,785,442; 5,597,249; 6,241,407; and 6,609,844.

SUMMARY

It is a feature of the disclosed embodiments to provide an improved printer and in particular a portable printer which is lightweight, compact, durable, user-friendly, easy to load and unload of label and tag supplies in a roll and fan-fold form and an ink ribbon cartridge, and has minimal parts almost all of which are of molded plastics construction. Various other features will be readily evident to persons skilled in the art by reference to the drawings and the detailed description that follow.

BRIEF DESCRIPTION OF THE DIAGRAMMATIC DRAWINGS

DETAILED DESCRIPTION OF THE PREFERRED EMBODIMENTS

Figure 1:
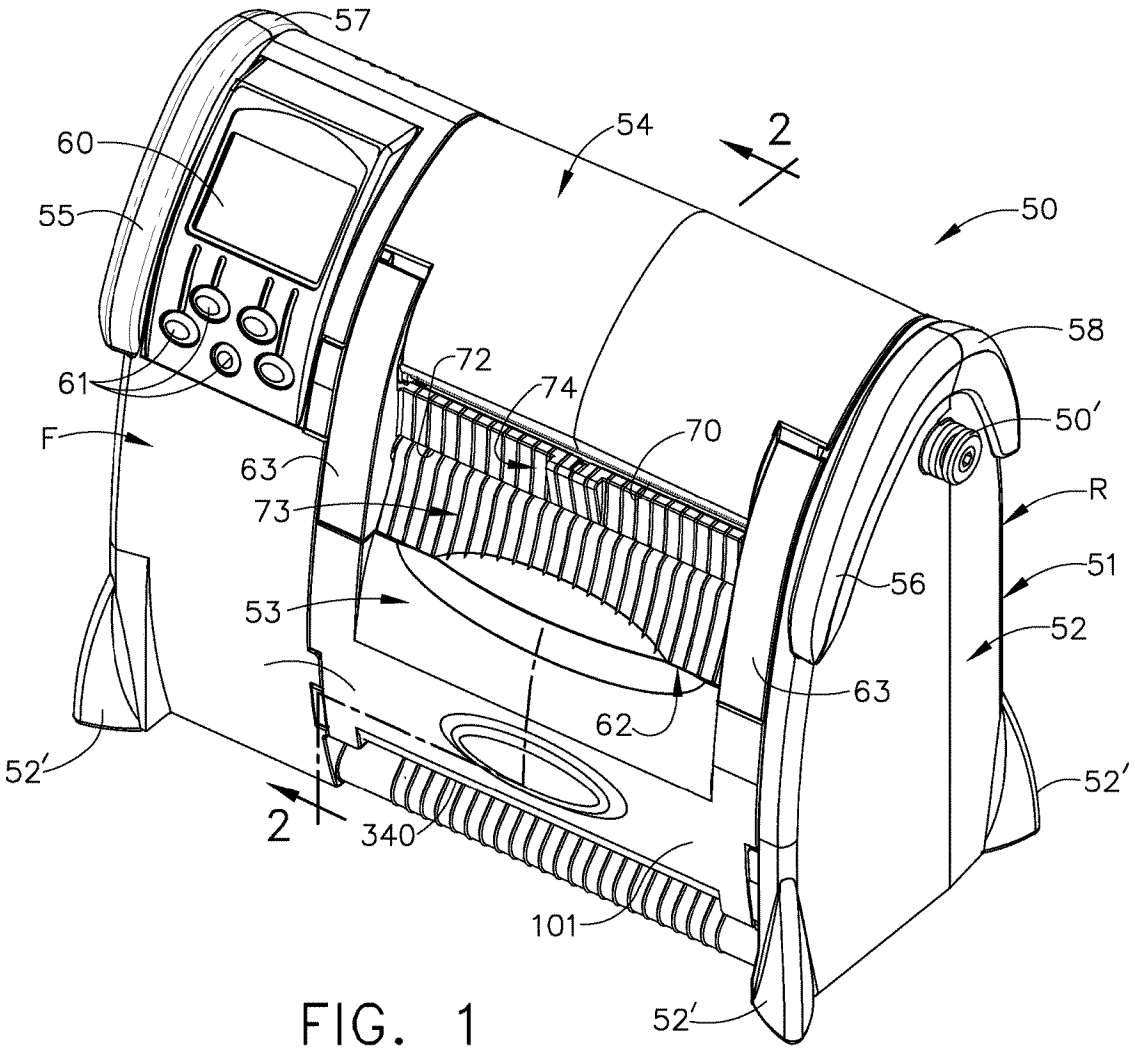
FIG. 1 is a pictorial view of a printer in accordance with an embodiment.

With reference initially to FIG. 1, there is shown a printer generally indicated at 50 having a housing generally indicated at 51. The printer 50 is portable and can be easily carried by a strap (not shown) on opposed posts 50' (only one of which is shown) or used on a table or other surface. The printer 50 is lightweight and has a small footprint. The housing 51 includes a main housing section 52, another housing section 53 which is movable relative to the housing section 52 and a third housing section 54. The housing sections 52 and 53 open relative to each other like a clam shell. The use of the term "main" for the housing section 52 is only to distinguish it from the housing section 53, not to signify dominant importance. The housing section 52 may stand on a horizontal surface such as a table and be supported at bumpers 52' in the form of preferably identical feet at the four corners of the housing 51. The housing section 54 preferably takes the form of an ink ribbon cartridge. The housing section 52 also has front bumpers 55 and 56 and rear bumpers 57 and 58. The bumpers 55 and 56 are the same, except that the bumper 55 is a left-hand version and the bumper 56 is a right-hand version. Likewise, the bumpers 57 and 58 are the same, except that the bumper 57 is a left-hand version and the bumper 58 is a right-hand version. The bumpers 52' and 55 through 58 are disposed at least at the corners of the main housing section 52 and extend outwardly so that in the event the printer 50 falls on a flat surface one or more of the bumpers will impact the flat surface and not any part of the housing 51, except for the posts 50'. The posts 50' may project outwardly beyond the bumpers 52' and 55 through 58 and thus the areas of the housing section 52 where the posts 50' are mounted are made thicker. The front of the printer 50 is designated F and the rear of the printer 50 is designated R. The front F also includes a display 60 and a keypad or keys 61 to control various printer functions. The housing sections 53 and 54 are connected by a toggle mechanism 62 which has spaced gripper arms 63.

Figure 2:
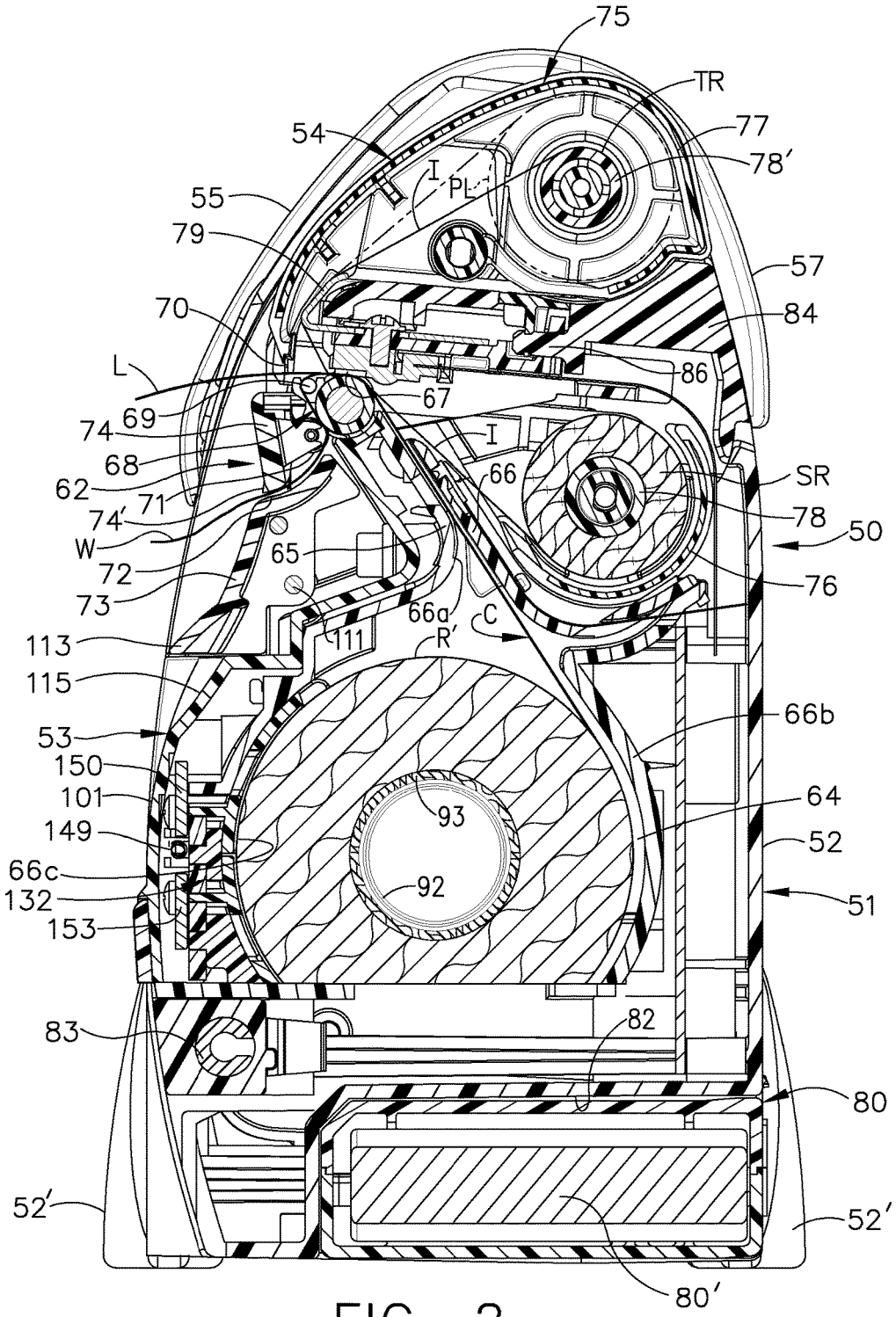
FIG. 2 is a sectional view through the printer taken along line 2-2 of FIG. 1.
Figure 3:
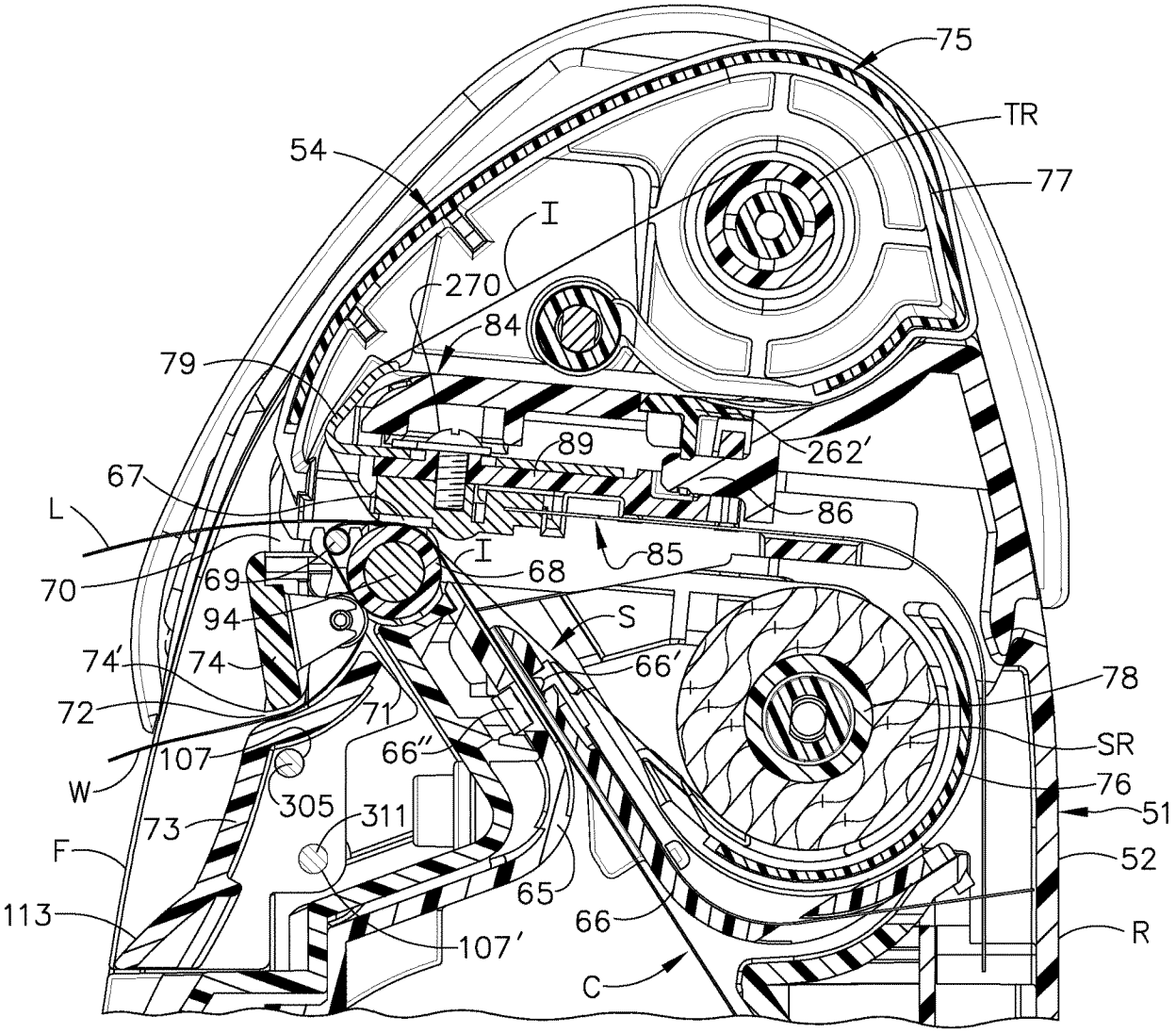
FIG. 3 is an enlarged sectional view showing the upper portion of the printer.

With reference to FIGS. 2 and 3, there are shown the housing sections 52 and 53 which help define space 64 for reception of a roll R' of a composite web C of record members. The record members can comprise paper labels L releasably adhered to a carrier web W as illustrated, or they can comprise tags or forms. The composite web C for example can pass from the roll R' to between a guide wall 65, and a guide 66, and a holder member 91. The member 66 has a dual purpose of guiding the web C and of mounting part of a sensor system S including a light source 66' (FIG. 3) and a light source/sensor 66". The light source 66' can be a light emitting diode for example OPR5200 and the light source sensor can be Type OPR5005, both sold by Optek Technology, Inc. Carrollton, Tex. The light from the light source 66' can pass through an aperture or notch in the web C or through the web W between spaced labels L and can be detected by the sensor of the light source/sensor 66" for web registration purposes or the light source/sensor 66" can detect edges between spaced adjacent labels L. The light source/sensor 66" can also detect registration marks on the underside of the web C by shining light from the light source portion of the light source/sensor 66" onto the underside of the web C and detecting the registration mark with the sensor portion of the light source/sensor 66". It is preferred to mount the light source 66' and the light source/sensor 66" as shown and described however, a different arrangement can be used, for example, a sensor can be mounted on the member 66 at the location where the light source 66' is disposed and the light source for that sensor can be located where the light source/sensor 66" is disposed. Alternatively, the positions of the light source/sensor 66" and the light source 66' can be reversed. Accordingly, because the member 66 acts as a guide it is properly termed a guide or guide member or a member, however, because the member 66 serves as a mount for part of the sensing system S it is properly called a mounting member or member. From between guides 65 and 66 the composite web C can pass to a nip between an elongate thermal print head 67 and a platen roll 68. From there the carrier web W passes partly around a delaminator 69 and the printed label L passes through an exit opening 70 (FIG. 2) and along an exit path between the gripper arms 63 (FIG. 1). After passing about the delaminator 69 at a sharp angle, the carrier web W passes between and into contact with the platen roll 68 and a back-up or pressure roll 71. From there the web W passes through an exit opening 72 between toggle members 73 and 74.

The housing section or specifically the ink ribbon cartridge or cassette 54 is comprised of a cartridge frame or housing generally indicated at 75. The frame 75 includes an ink ribbon supply frame section 76 and a spent ink ribbon section 77 joined to each other. The frame section 76 mounts a supply roll spindle 78 about which an ink ribbon supply roll SR is wound. Ink ribbon I passes from the supply roll SR over the composite web C to the nip between the print head 67 on the one side and the web C and the platen roll 68 on the other side. From there the spent ink ribbon I passes about a guide 79 preferably in the form of a guide plate and from there the spent ink ribbon I passes to the take-up roll TR where the spent ink ribbon I is accumulated. As the printer 50 operates and the ink ribbon I is advanced from the supply roll SR to the take-up roll TR, the size of the take-up roll TR grows until the supply roll SR is exhausted and the take-up roll TR is full as indicated by the circular phantom line PL. The take-up roll TR is wound on a take-up spindle 78'.

Figure 17:
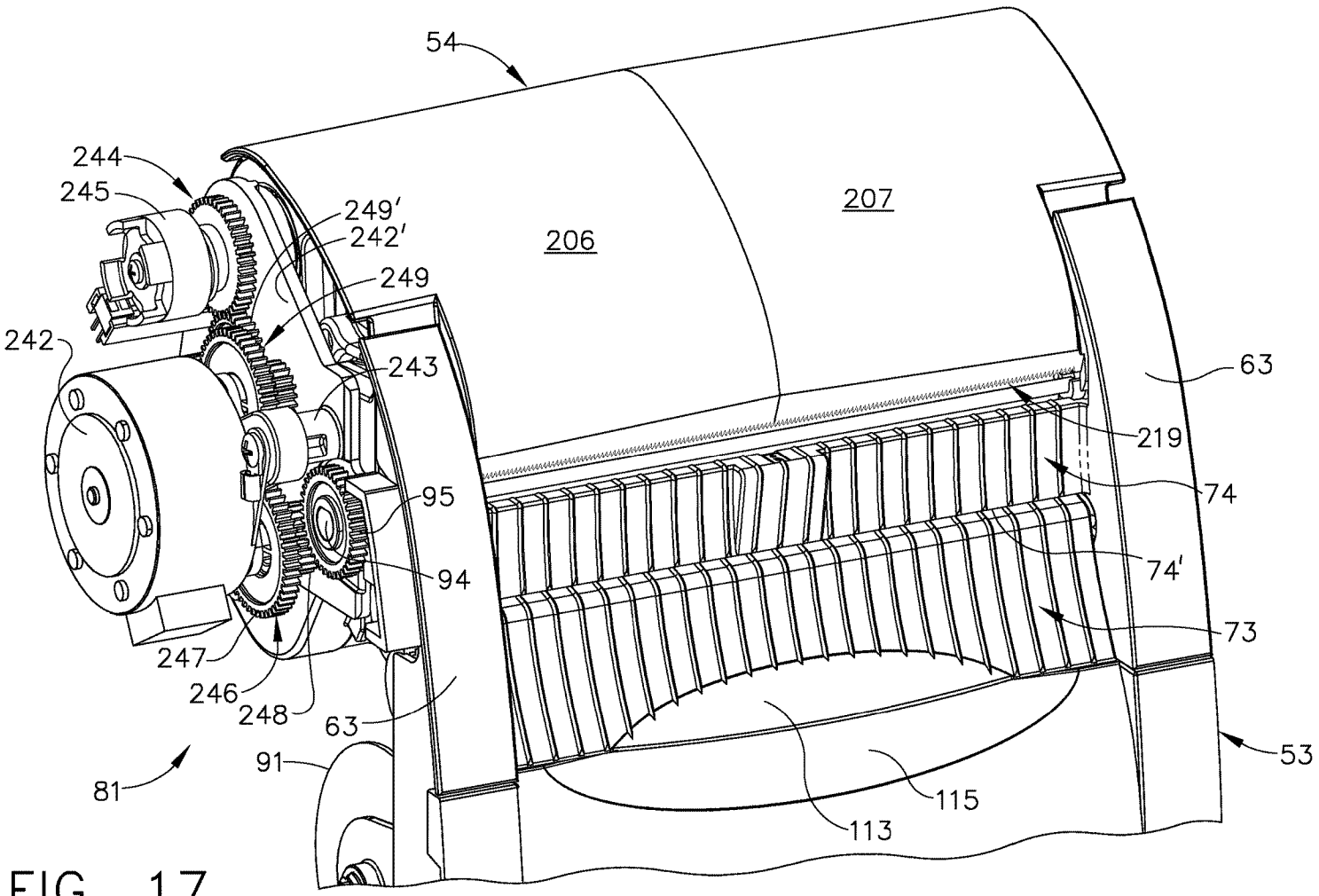
FIG. 17 is a pictorial view of a portion of the printer showing the ink ribbon cartridge latched in position and broken away to expose the drive mechanism for the ink ribbon cartridge and the platen roll.

The section taken to create FIG. 2 shows the battery pack 80 including preferably a plurality of batteries 80' used to power the circuitry (not shown) and the drive mechanism or drive assembly 81 (FIG. 17). The battery pack 80 is received in a compartment 82 in the housing section 52.

FIG. 2 also shows one of the two axially aligned pivots 83 for the housing section 53. The housing section 53 which functions as a door and, in particular, a front door is movable about the pivots 83 between a closed position shown in FIGS. 1 and 2, for example, and an open position shown in FIGS. 5 and 6.

FIG. 3 shows the upper portion of FIG. 2 on a larger scale. FIGS. 2 and 3 show that the housing section 52 has a cantilevered support 84 which mounts a print head assembly 85 and is capable of removably receiving and supporting the ink ribbon cartridge 54. The support 84 has a projection 86 about which the print head assembly 85 is pivotal or gimbaled.

Figure 4:
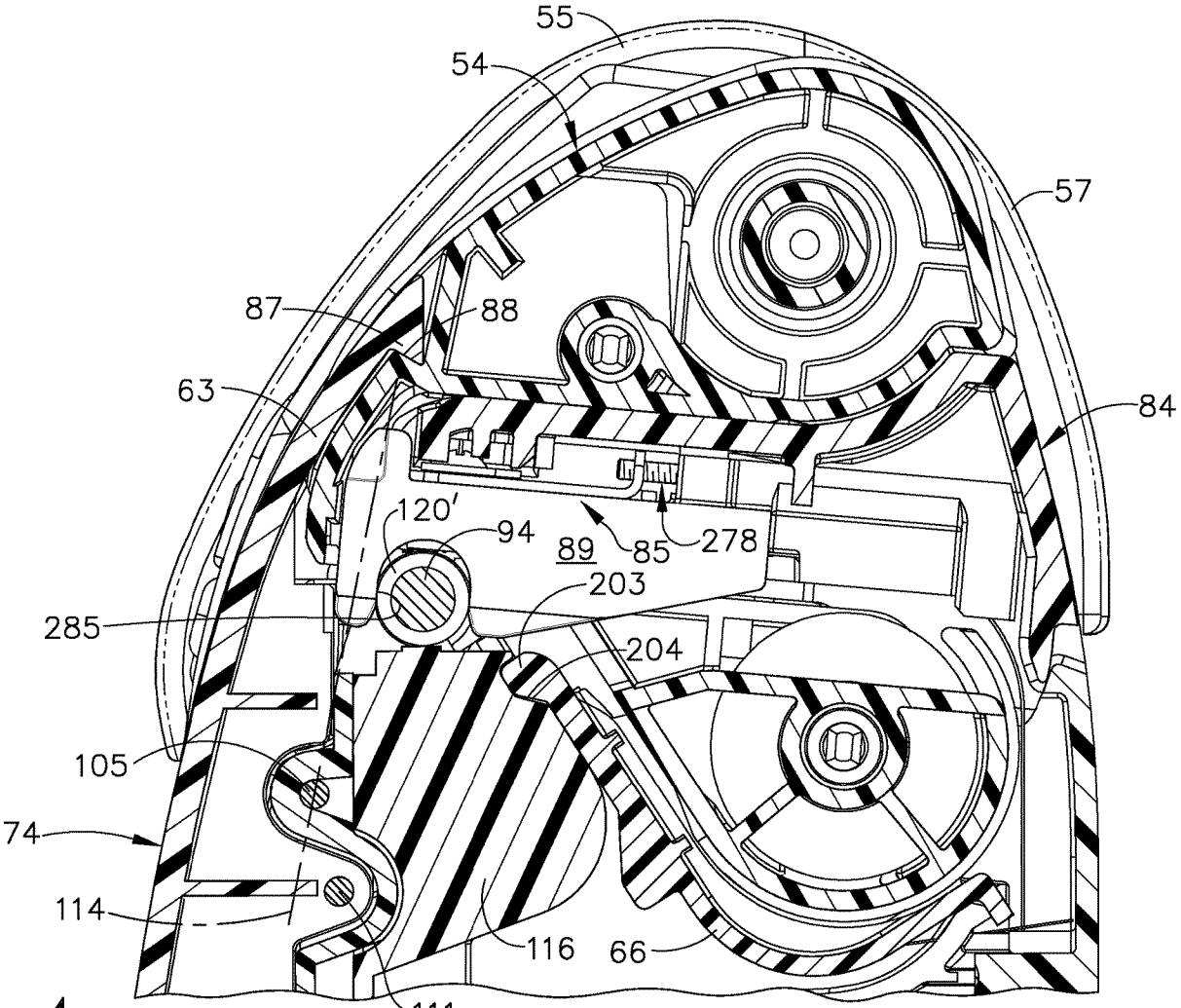
FIG. 4 is an enlarged sectional view of the printer along a different line than in FIGS. 2 and 3.

FIG. 4 is a view taken through one of the gripper arms 63 and shows how a tooth 87 engages a gripper or gripped surface 88 on the cartridge 54. FIG. 4 also shows the manner in which the print head assembly 85 and in particular its print head support 89 can locate on the bearing 120 for the platen roll 68.

Figure 5:
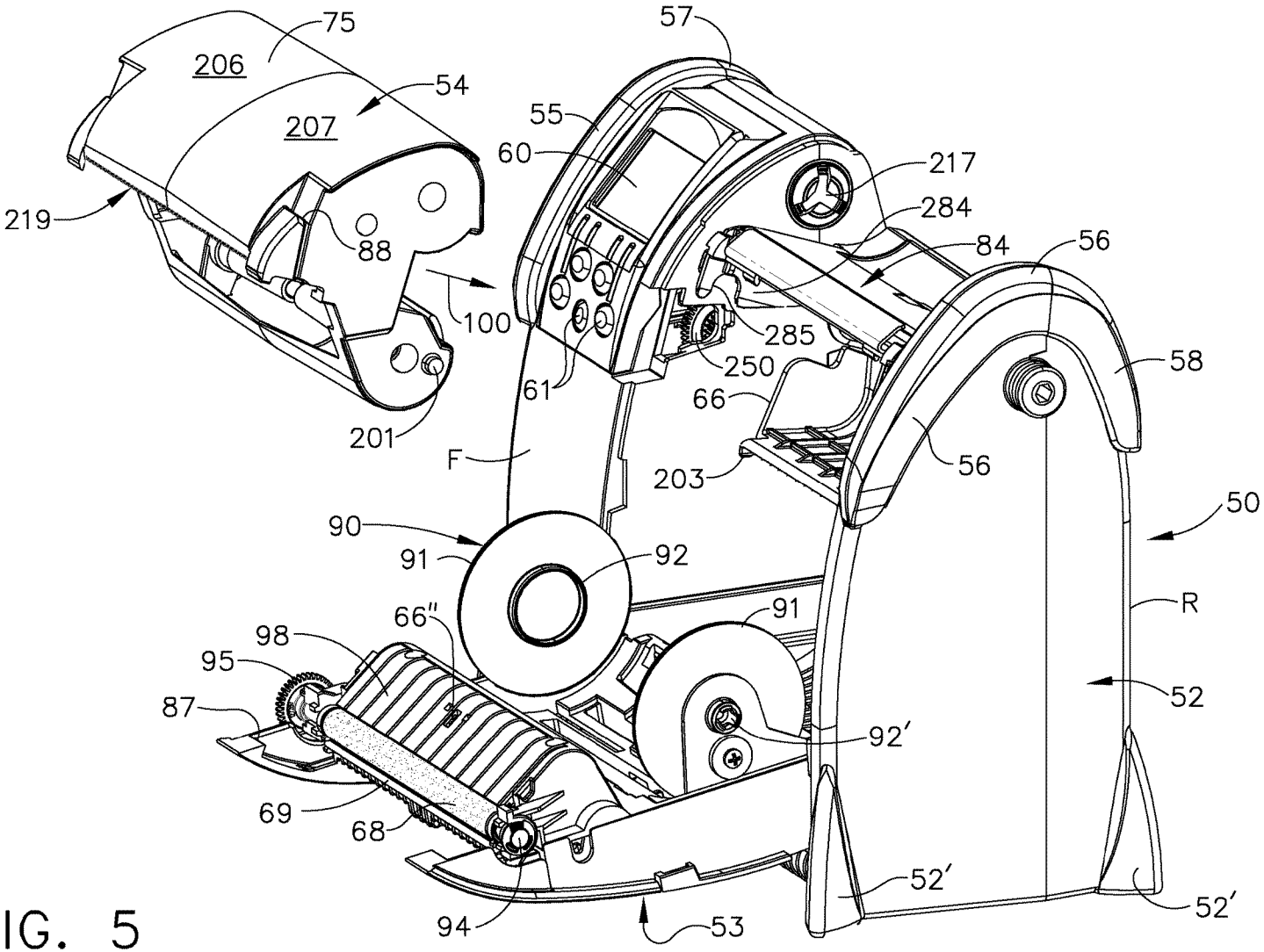
FIG. 5 is a pictorial view of the printer with the front door open and with an ink ribbon cartridge exploded away.
Figure 6:
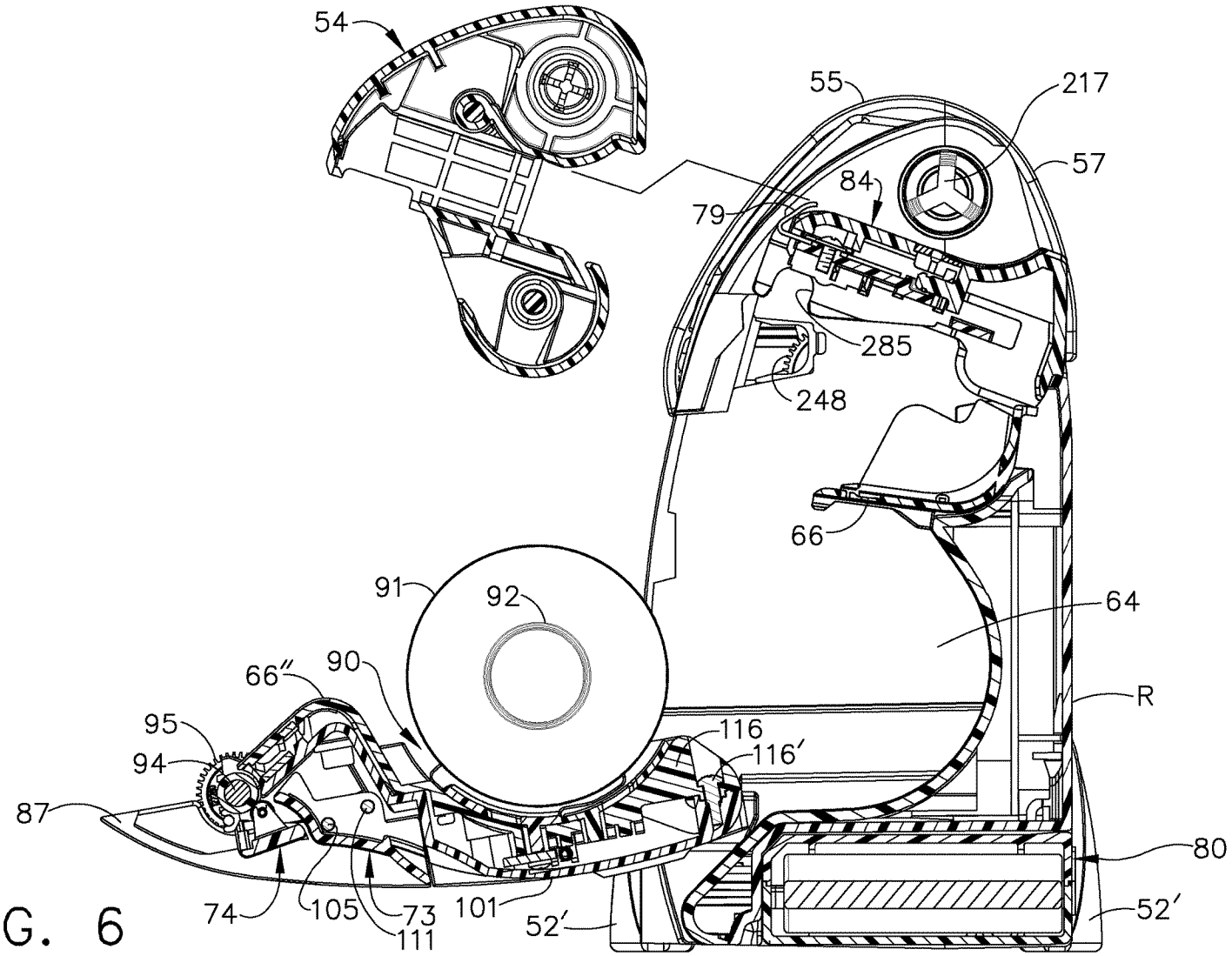
FIG. 6 is a sectional view of the printer with its front door open and the ink ribbon cartridge exploded away.

With reference to FIG. 5, the housing section or door 53 is shown to mount a label roll holder generally indicated at 90. The label roll holder 90 can be any suitable structure to mount a label or tag roll, however, it is preferred that the holder 90 have holder members 91 engageable with the label or tag roll R' and which are movable relatively toward and away from each other in unison to center-justify the label roll R' with respect to the center of the elongate print head 67. The holder members 91 are preferably identical and are shown to be in the form of discs have having projections or hubs or hub portions 92 capable of fitting preferably with a close fit into the inside of a core 93 of the label roll R'. The door 53 also rotatably mounts the platen roll 68 which has a platen shaft 94 and a gear 95 secured to the shaft 94.

The gripper arms 63 are spaced outboard of the exit path 70 (FIGS. 1 and 2) along which a record member, for example, label L exits the printer 50. It is also apparent from FIG. 5 that the printer 50 is easy to load by moving the holder members 91 apart and allowing the projections 92 to enter into the inside of the core 93. The user may strip several labels L from the carrier web W and lay the spent web W across the platen roll 68 and then pass the web W partially around the delaminator 69 and insert the web W between the platen roll 68 and the pressure roll 71 and out through exit opening 72. Then the user can move the door 53 to its closed position as shown in FIG. 1 for example and may tug on the web W which is beyond the exit opening 72 to remove any slack from the web W. It is evident from the figures such as FIG. 1 that the exit openings 70 and 72 are readily accessible in open space between gripper arms 63 from the outside of the printer 50.

FIG. 5 also shows the ink ribbon cartridge 54 ready to be inserted into the housing section 52 in the direction of arrow 100 and onto the support 84.

Figure 7:
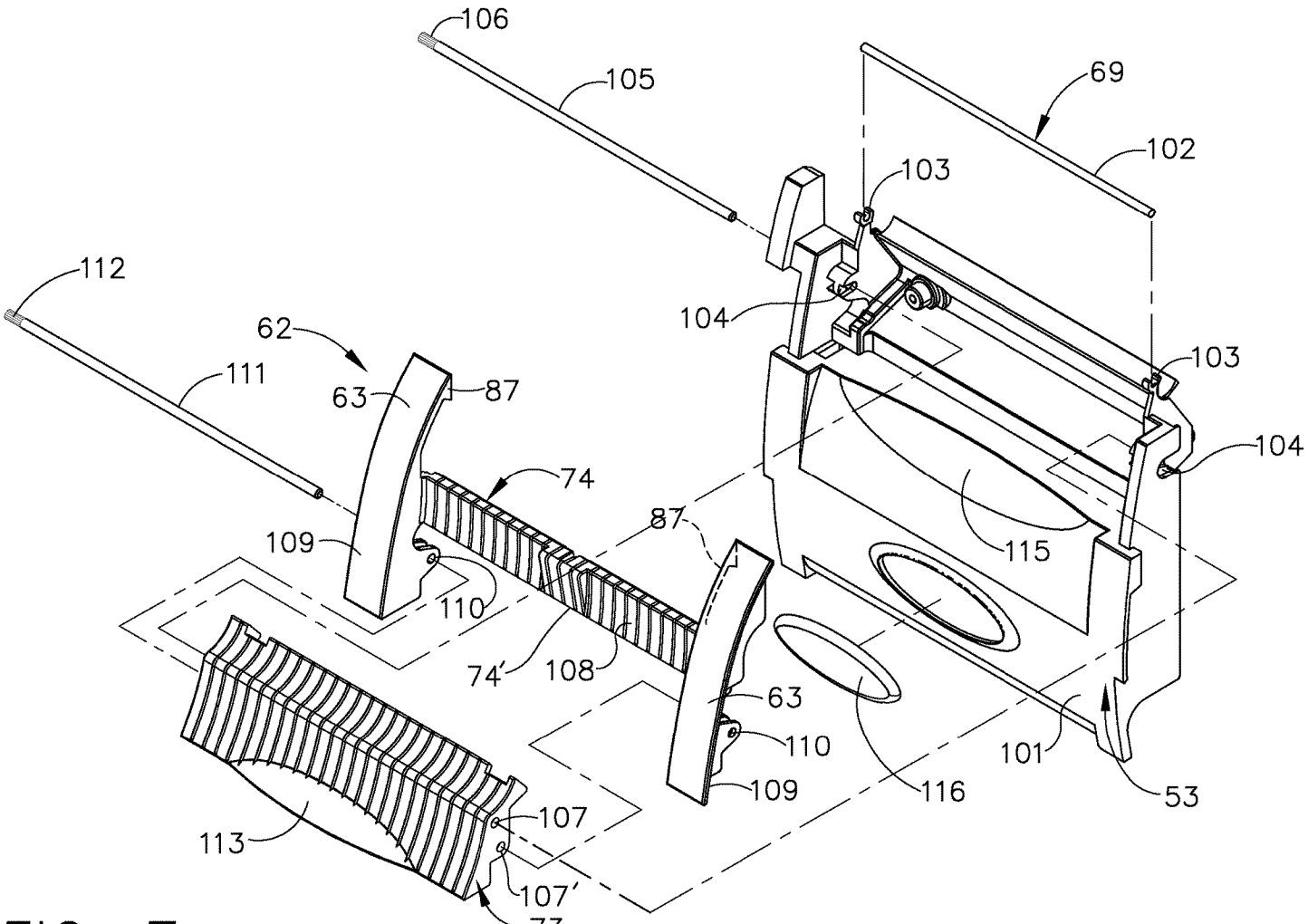
FIG. 7 is an exploded pictorial view of the front door and a toggle latch mechanism on the door.
Figure 8:
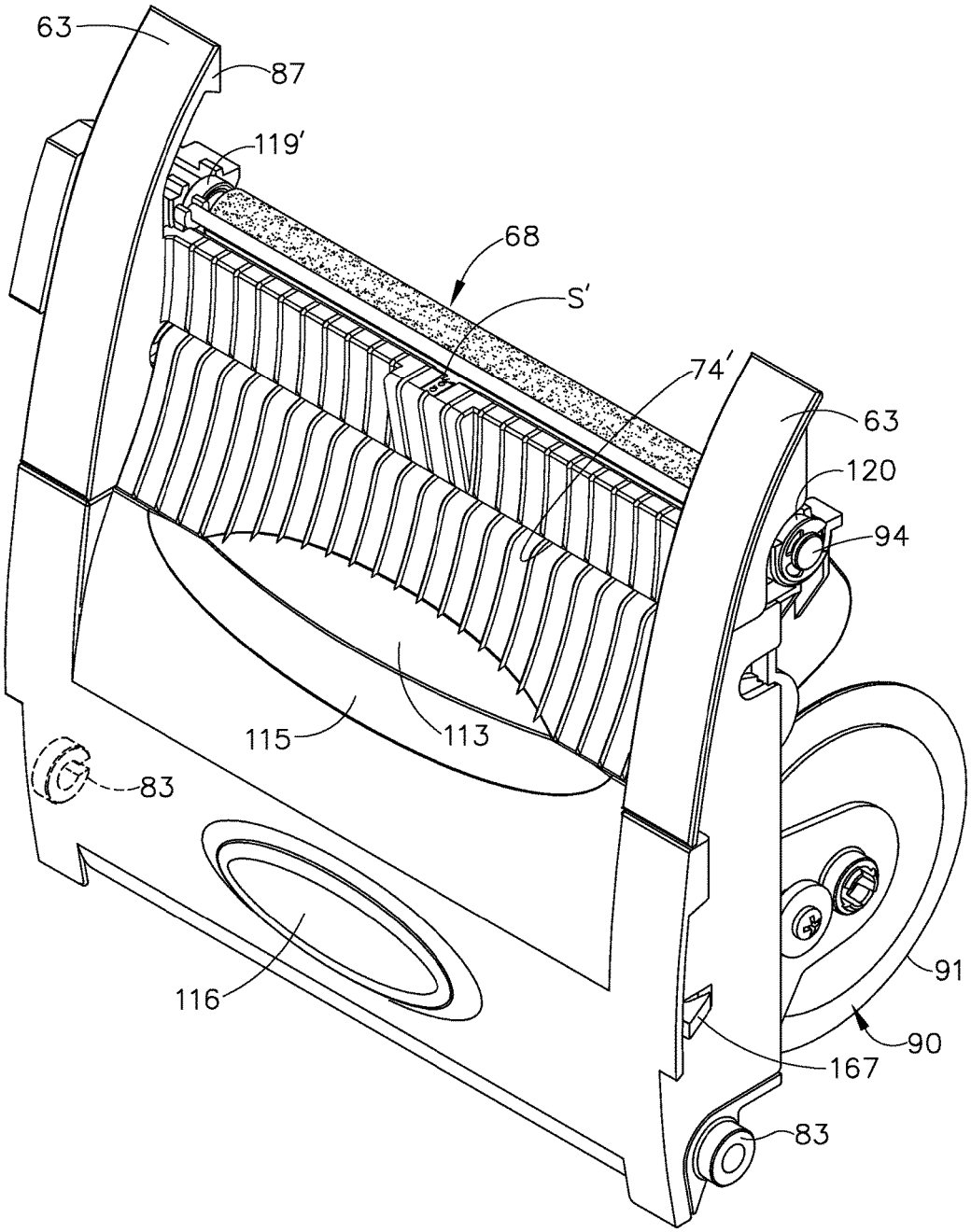
FIG. 8 is an assembled pictorial view of the front door on which a platen roll, a delaminator, a tear edge, a toggle latch mechanism and a roll mounting assembly are mounted.

With reference to FIG. 7, there is shown the outer panel or plate 101 of the door 53 and the toggle mechanism 62. The panel 101 mounts the delaminator 69 shown to take the form of a roller or peel roller 102. The delaminator 69 can alternatively be a peel plate (not shown), however, a peel roller 102 is a preferred form of a delaminator. The preferably one-piece panel or plate 101 has a pair of space C-shaped sockets 103 which capture end portions of the roller 102. The panel 101 has a pair of aligned holes 104 which mount a shaft 105. One end portion 106 of the shaft 105 is knurled and is press-fitted into the hole 104 at the left side of the panel 101. The shaft 105 passes through a through-hole 107 in the preferably one-piece toggle member 73 to mount the toggle member 73 for pivotal movement. The preferably one-piece toggle member 74 is shown to include a bar or transverse connector 108 that connects the gripper members 63 to each other. The teeth 87 are located in one direction, for example, above the connector 108 and extensions or shaft mounting members 109 extend in the other direction or below the connector 108. The connector 108 preferably rigidly connects the one gripper member 63 to the other gripper member 63 and connects the one member 109 to the other member 109. The members 109 have aligned holes 110 to receive a shaft 111. The toggle member 73 is disposed between gripper arms 63 and the shaft 111 passes through a hole 107' in the toggle member 73. An end portion 112 of the shaft 111 is knurled. The end portion 112 is press-fitted into the hole 110 of the member 109 at the left side of the toggle member 174. In order to release gripper members 63 so that teeth 87 no longer engage the gripped surfaces 88 on the cartridge 54 and so that the cartridge 54 can be removed from the remainder of the printer 50, the user can insert a finger beneath a handle 113 (FIGS. 2, 3, 4 and 7) and pull the toggle member 73 to move clockwise about the shaft 105. As the toggle member 73 starts to move clockwise in FIG. 4 for example about the shaft 105, the gripper teeth 87 exert increased force against the gripped surfaces 88. As the toggle member 73 continues to move clockwise even further, then the shaft 111 moves from the right side of a centerline 114 to the left side of the centerline 114. In FIG. 4, the shaft 111 is overcenter with respect to the centerline 114 in one direction at a latched condition or state. When the shaft 111 has moved to the left of the centerline 114, the shaft is overcenter in the other direction which causes loosening of the gripper teeth 87 from the gripped surfaces 88 until the gripper arms 63 are free of the cartridge 54. Now the ink ribbon cartridge 54, the support 84 and the print head 85 can be manually pivoted slightly clockwise as viewed in FIG. 4 to disengage guide slots 285 from bearings 119' and 120'. The door 53 can now be moved to its open position with respect to the housing section 52. When the door 53 is moved to the closed position, the teeth 87 are at a position over and spaced from the gripped surfaces 88. By pushing on the handle 113, the toggle member 73 is pivoted counterclockwise (FIGS. 4 and 7 for example) to bring the shaft 111 and the gripper members 63 to the closed position shown in FIG. 4 for example, and thus the shaft 111 has moved to the right of the centerline 114. FIGS. 2, 7 and 8 show the panel 101 as having a recess 115 to provide ready finger access by the user to the underside of the handle 113. The panel 101 can also be provided with a logo plate 116. The toggle member 74 also has an on-demand sensor S' (FIG. 8) which can sense the presence of a label L at the exit opening 70.

Figure 9:
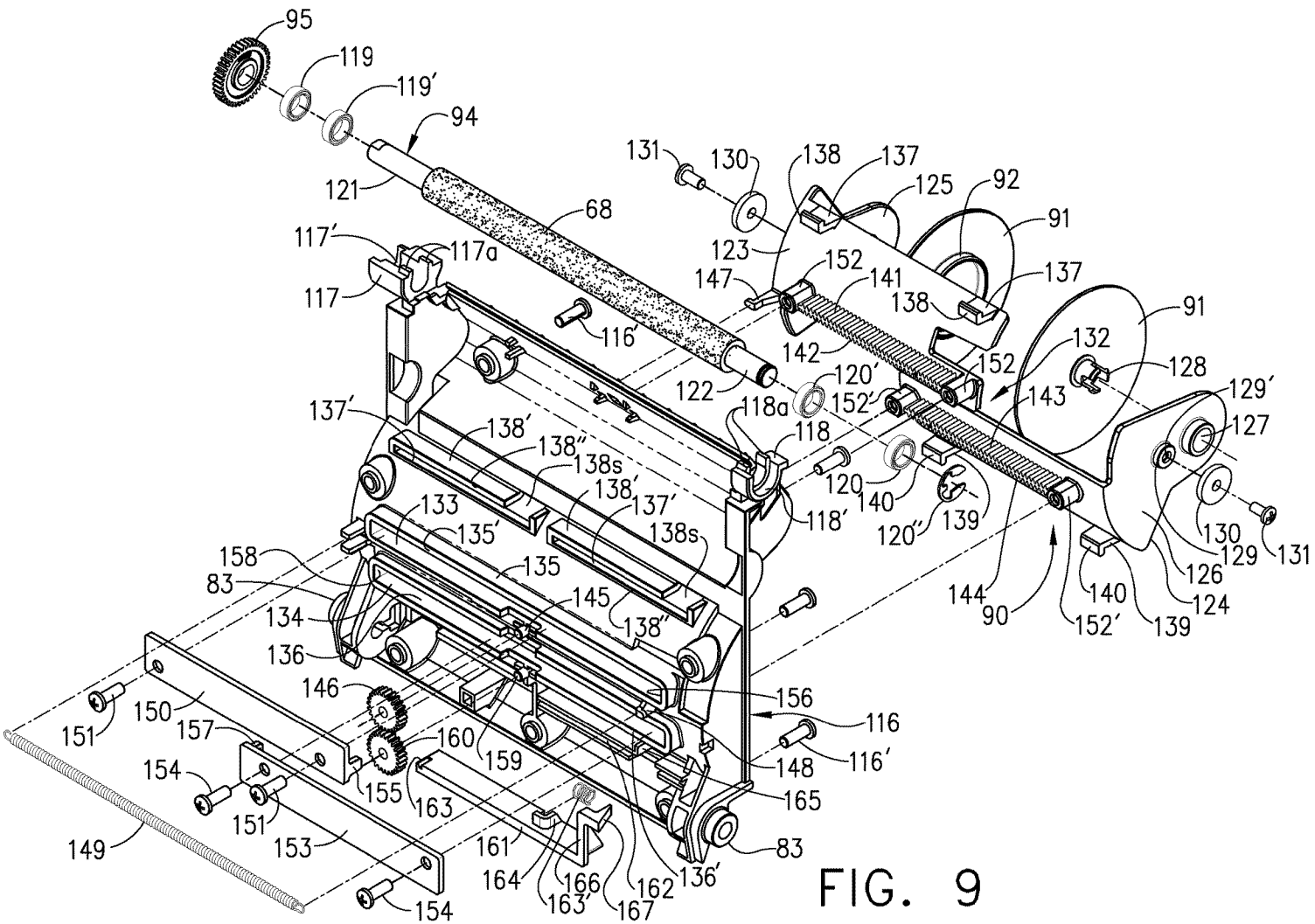
FIG. 9 is an exploded pictorial view of a portion of the printer showing a portion of the door, the roll mounting assembly and the platen roll.

With reference to FIG. 9, there is shown an inner panel or plate generally indicated at 116 attached to the panel or plate 101 by screws 116'. The preferably one-piece panel 116 has a pair of aligned C-shaped sockets 117 and 118. Ball bearings 119 and 120 are received in respective socket portions 117' and 118' of the sockets 117 and 118 and ball bearings 119' and 120' are in contact with the inboard sides of the respective sockets 117 and 118. The shaft 94 has one end portion 121 received in the ball bearings 119 and 119' and another end portion 122 received in the ball bearings 120 and 120'. An E-ring 120" keeps the bearing 120 on the end portion 122. The gear 95 is press-fitted onto the end portion 121 and holds the bearing 119 in place.

The label roll holder 90 includes a pair of identical slides 123 and 124. The preferably one-piece slides 123 and 124 have respective arms 125 and 126. Each arm 125 and 126 has a hole 127 into which an integral connector 128 on the disc 91 is received. The connectors 128 enable the discs 91 to rotate relative to their respective arms 125 and 126.

Figure 35:
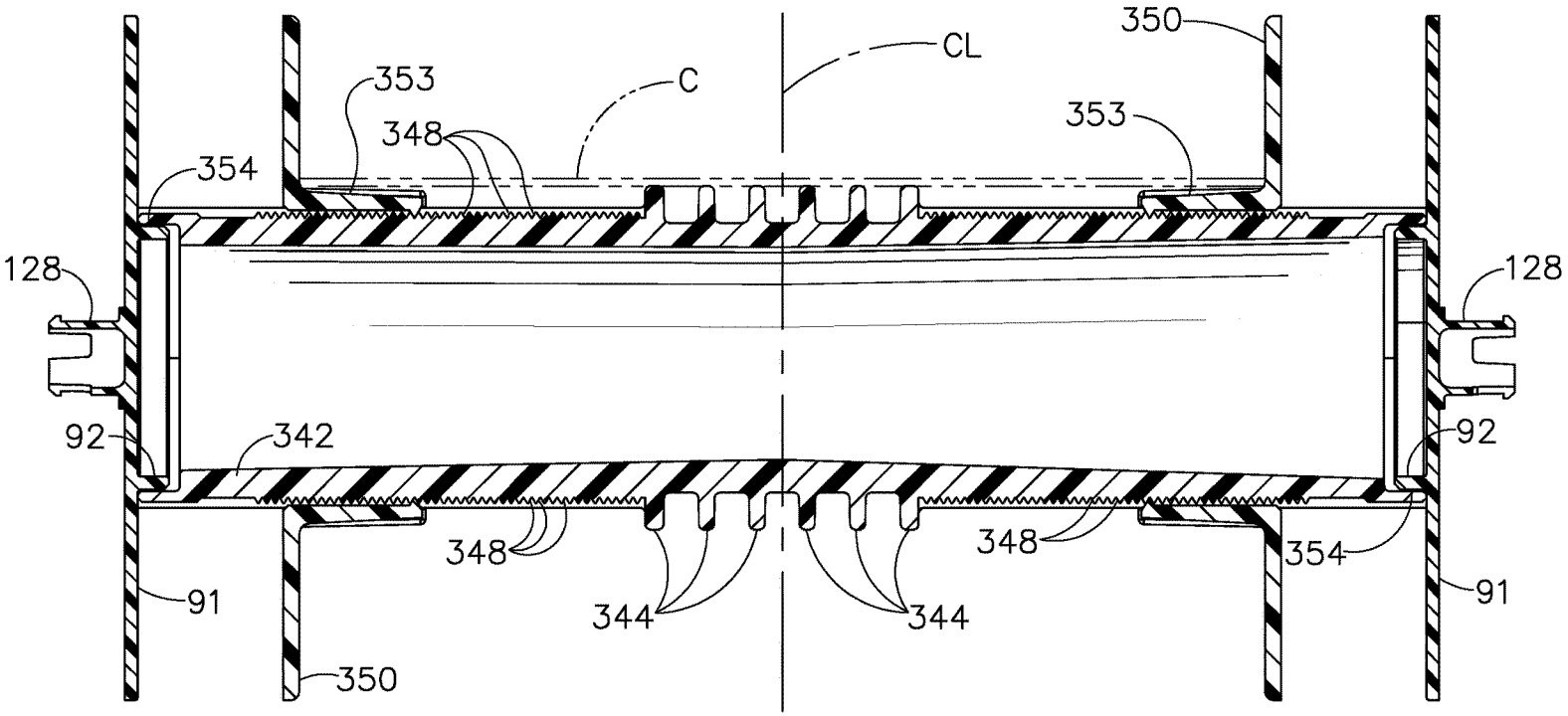
FIG. 35 is a sectional view of the guide held in a label roll holder.

Each arm 125 and 126 has an outwardly extending boss 129 having a hole 129'. Handles 130 preferably in the form of washers are held onto the bosses 129 spaced from the outer surfaces of the respective arms 125 and 126 by screws 131. Either handle 130 enables the user to insert a fingernail between the handle 130 and the outer surface of the respective arm 125 or 126 and pull outwardly, thereby causing the roll mounting members 91 to move apart should it be desired, for example, to remove a spent core 93 or a guide 341 (FIG. 35 for example). Alternatively, either handle 130 can be grasped between two fingers to spread the holder members 125 and 126 apart. It is noted that when one holder member 125 or 126 is moved outwardly away from the other holder member 126 or 125, a rack and pinion mechanism generally indicated at 132 moves the other holder member 126 or 125.

The panel 116 has a pair of parallel slots 133 and 134 bounded by respective flanges 135 and 136. The slide 123 has a pair of L-shaped members 137 with flanges 138. The members 137 extend through slots 137' bounded by flanges 138' having end surfaces 138". The flanges 138 contact the end surfaces 138". Likewise, the slide 124 has a pair of L-shaped members 139 with flanges 140, which are received in similar slots (not shown) that are mirror images of the slots 137'. The members 137 are assembled through respective slots 138*s*.

The slides 123 and 124 have double racks or straight gears 141 and 142 and 143 and 144, respectively. The panel 116 has an integrally molded pin 145 on which is gear or pinion 146 can be rotatably mounted. The gear 146 is coupled to and can mesh with racks 142 and 143. The slide 123 has a post 147. The slide 124 was molded with a post (not shown) like the post 147 which can be cut off before assembly of the printer 50. The pinion 146 assures that the slides 123 and 124 move equal distances to keep the arms 125 and 126 and the discs 91 at equal distances with respect to the centerline between the ends of the elongate print head 67. A tension spring 149 is hooked onto the post 147 and onto a post 148 on the panel 116. The spring 149 is under tension and acts to urge the slides 123 and 124 and their respective arms 125 and 126 toward each other.

A keeper or plate 150 slidably contacts the end surface 135'. Screws 151 pass through the plate 150 and are received in bosses 152. Likewise a keeper or plate 153 slidably contacts the end surface 136'. Screws 154 pass through the plate 153 and are received by bosses 152'. The bosses 152, the post 147 and the racks 141 and 142 travel in the slot 133 and the bosses 152' and the racks 143 and 144 travel in the slot 134. A tang or stop 155 on the plate 150 projects into the slot 133 and can contact end 156 of the slot 133 to prevent the members 137 from aligning with the slot 138*s* and to thereby prevent the members 137 from coming out of the slot 137' during use. A tang or stop 157 on the plate 153 projects into the slot 134 and can contact end wall 158 to prevent members 139 from coming out of their respective slot 134 during use.

Figure 11:
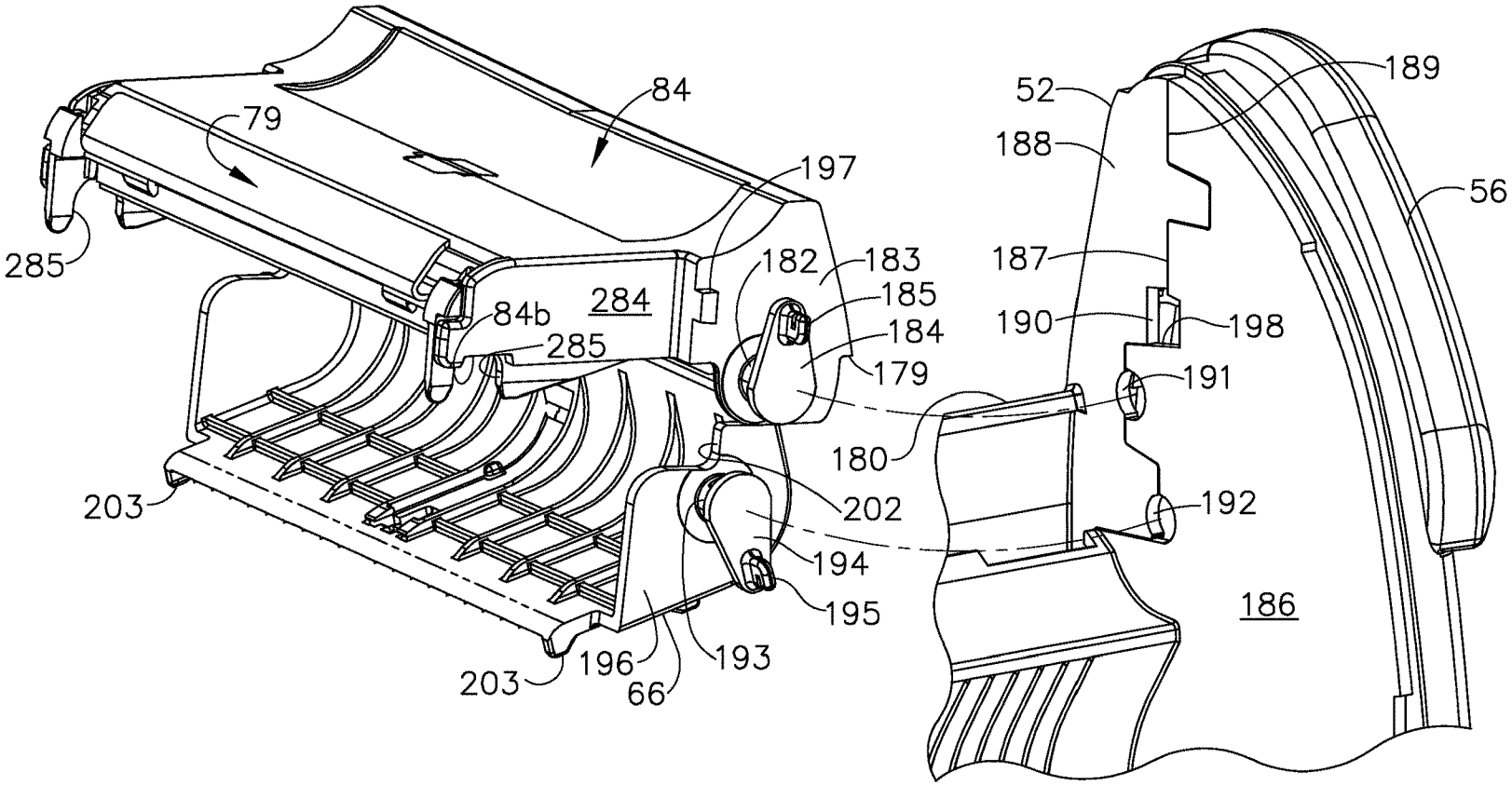
FIG. 11 is a rotated, exploded, pictorial view of another portion of the printer.

The panel 116 also has a post 159 for mounting a gear 160 which is coupled to and can mesh with the rack 144. A plate or slide 161 guided in a slot 162 has a tooth 163 which can engage a tooth of the gear 160 below the axis of rotation of the gear 160. The slide 161 is normally urged to the right as shown in FIG. 9 by a compression spring 163' that abuts against and is captive between a boss 164 and a surface 165 on the panel 116. An arm 166 joined to the slide 161 has a cam surface 167 used to move the slide to the left as viewed in FIG. 9. When the door 53 is being closed, the cam surface 167 contacts the housing section wall 186 as seen in FIG. 11 to urge the slide 161 to the left (FIG. 9) to engage the gear 160 and rotate the gear 160 clockwise (FIG. 9). This slight rotation of the gear 160 causes the pinion 146 to be moved slightly to cause the slides 123 and 124 and their respective discs 91 to move slightly apart. This causes the pressure and thus friction between the rotatable discs 91 and the arms 125 and 126 to be reduced and thus drag on motor 242 (FIG. 17) is reduced. When the door 53 is being opened, the spring 163' causes the tooth 163 to disengage from the gear 160.

Figure 10:
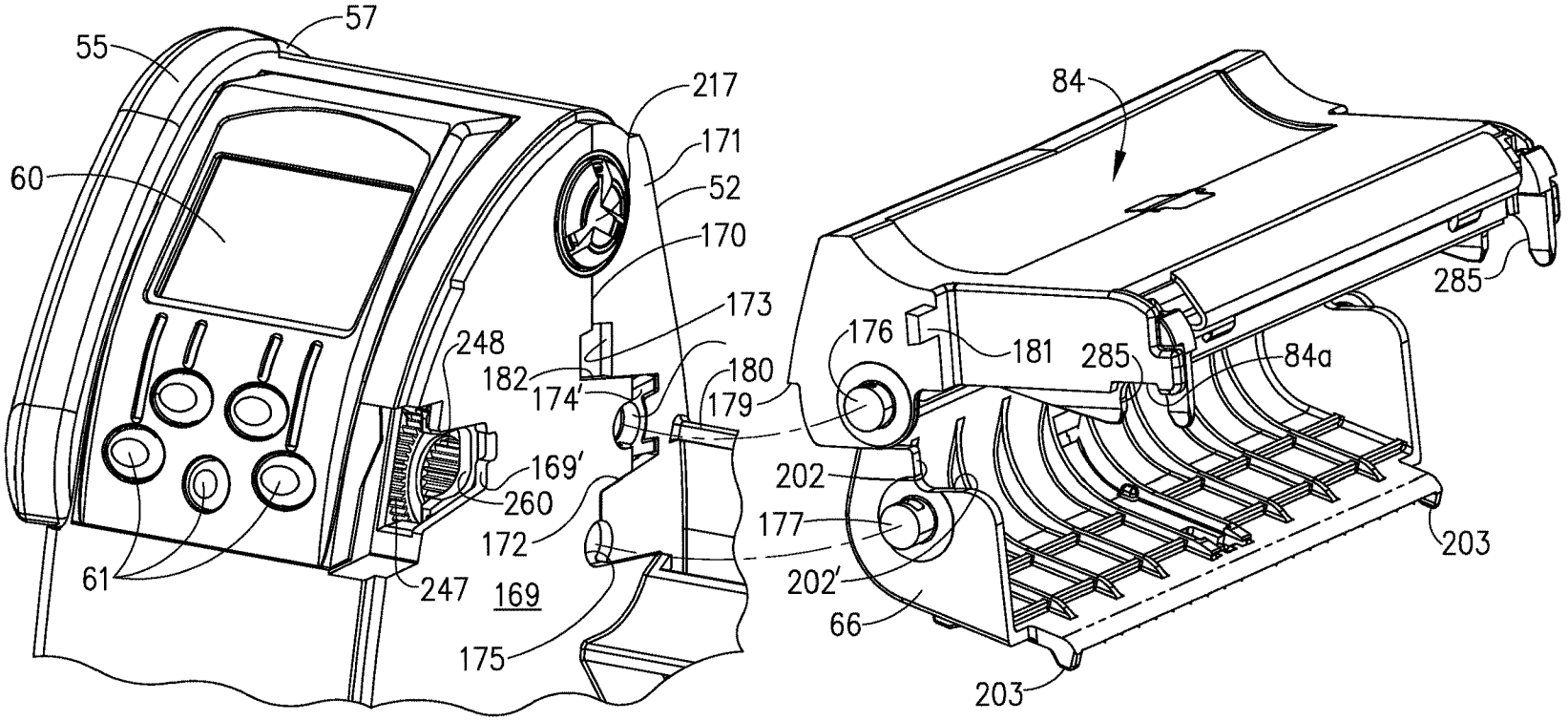
FIG. 10 is a rotated, exploded, pictorial view of a portion of the printer.

FIG. 10 shows the support 84 which is pivotally mounted to the housing 52. The front part of the housing section 52 has a panel 169 with an irregular rear edge 170. A panel 171 with an irregular edge 172 contacts and mates with the panel 169 and captures a flange 174' of the mounting plate 242', thereby defining a generally rectangular aperture 173 and round holes 174 and 175. The support 84 has an integral stud or shaft 176 pivotally received in the hole 174. The web guide and/or holder member 66 has an integral stud or shaft 177 pivotally received in the hole 175. The support 84 can pivot counterclockwise as viewed in FIG. 10 until a stop face 179 contacts a stop 180 on the housing section 52. The support 84 has a stop 181 which can bottom on a stop face 182 in the aperture 173 to limit the clockwise movement of the support as viewed in FIG. 10.

With reference to FIG. 11, the support 84 is shown to have a shaft or stud 182 rigidly secured to its side 183 in axial alignment with the shaft 176. An arm 184 having a hook-shaped connector 185 is rigidly secured to the shaft 182. The shaft 182, the side 183 and the arm 184 can be integrally molded. The front part of the housing section 52 has a panel 186 with an irregular rear edge 187. A panel 188 with an irregular edge 189 which contacts and can mate with the panel or housing section wall 186, thereby defining a generally rectangular aperture 190 and round holes 191 and 192. The shaft 182 is pivotally received in the hole 191 and the arm 184 is located in hollow space within the housing section 52. The preferably one-piece member 66 has a shaft or stud 193 and an arm 194 having a hook-shaped connector 195. The shaft 193 is axially aligned with the shaft 177. The member 66 includes a side wall 196. A stop 197 on side wall 183 fits into the aperture 190 and can bottom on a stop surface 198. The stops 181 and 197 are laterally aligned, the apertures 173 and 190 are laterally aligned, the holes 174 and 191 are laterally aligned, and the holes 175 and 192 are laterally aligned.

Figure 12:
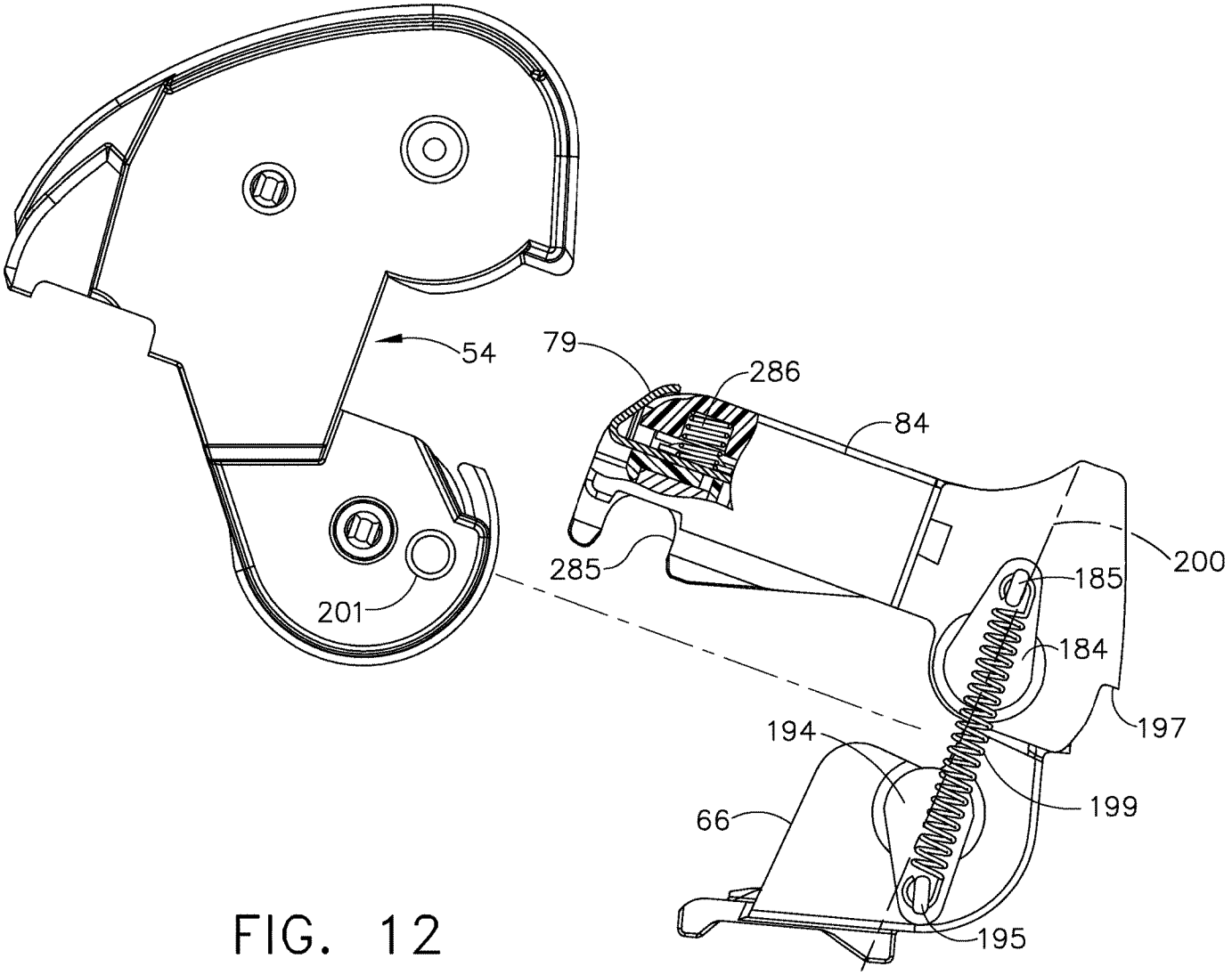
FIG. 12 is an exploded elevational view showing the printer in a position to be capable of receiving an ink ribbon cartridge.

With reference to FIG. 12, a tension spring 199 is hooked onto the connectors 185 and 195. The arms 184 and 194 and their connectors 185 and 195 are so positioned that in the open position shown in FIG. 12, the support 84 can receive the cartridge 54 or the cartridge 54 can be removed. The support 84 can have limited pivotal movement about aligned shafts 176 and 182, and the member 66 can have limited pivotal movement about aligned shafts 177 and 193. As seen in FIG. 12, a centerline 200 through the axes of rotation of the support 84 and the member 66 shows that the forces exerted by the spring 199 normally keep the member 66 in the open position to enable a cartridge 54 to be loaded or unloaded.

Figure 13:
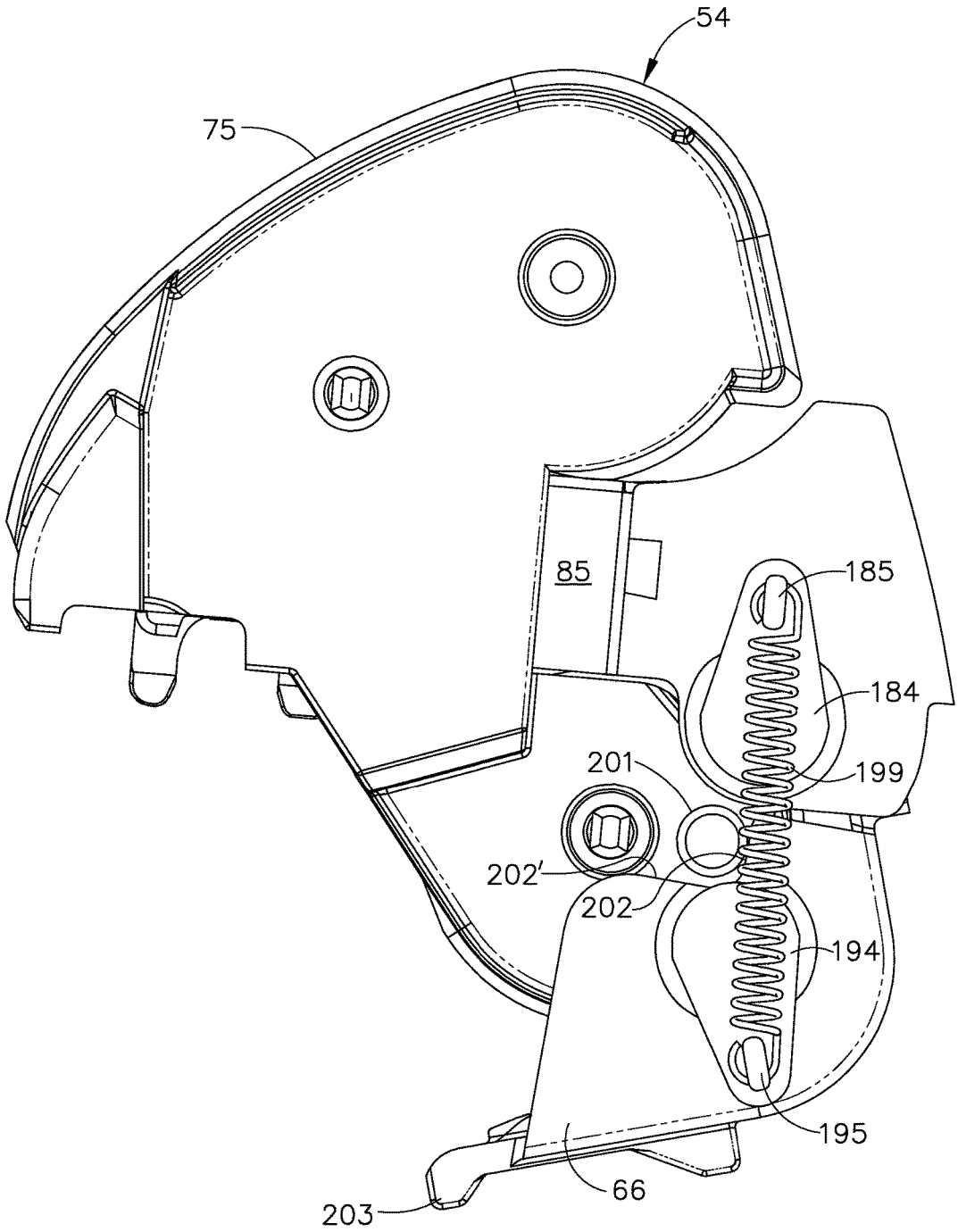
FIG. 13 is a side elevational view of a portion of the printer with the ink ribbon cartridge partly received in the printer.
Figure 14:
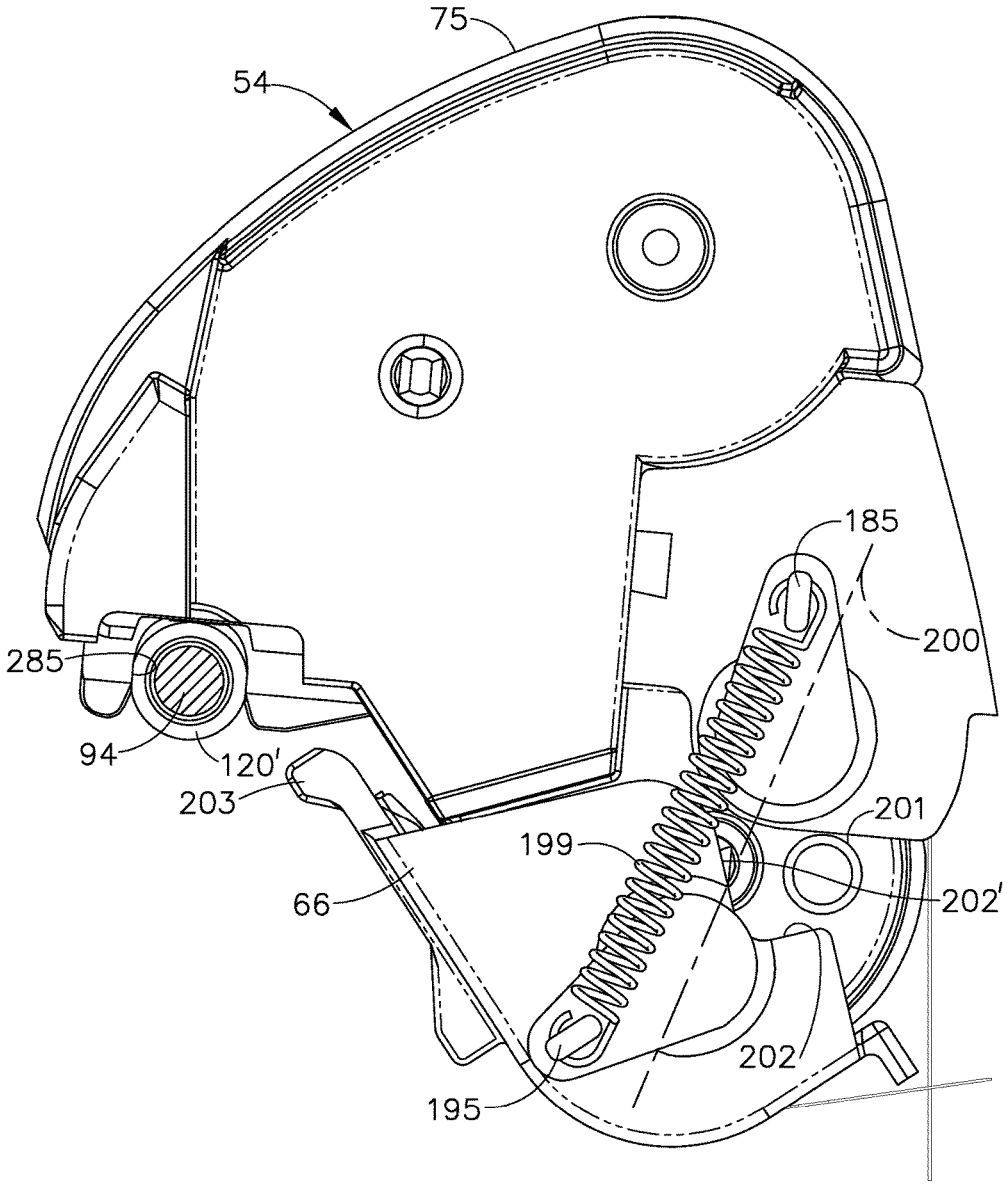
FIG. 14 is a view similar to FIG. 13, but showing the ink ribbon cartridge fully received in its operating position in the printer.

FIG. 13 shows the cartridge partially inserted into the operating position. There are actuators or posts 201 on the cartridge 54 which can touch cam faces 202 on the member 66. In that the posts 201 and the cam faces 202 are just touching, the member 66 continues to be held in the open position by the spring 199. Upon continued insertion of the cartridge 54 toward the operating position shown in FIG. 14, the actuators 201 cam the member 66 until the member 66 has rotated overcenter with respect to the centerline 200. As soon as the member 66 is overcenter, the spring 199 urges the member 66 to the operating position. Accordingly, the spring 199 can alternately hold the member 66 in either the open position (FIG. 12) or in the closed position (FIG. 14). The operating position is also shown in FIGS. 2 through 4 and 22 for example. When removing the cartridge 54, the posts or pins 201 act on cam surfaces 202' to drive the member 66 to its open position. The member 66 has projections 203 received in pockets 204 in the plate 116, one of which is shown in FIG. 4. The actuators 201 cooperating with cam faces 202 are sufficient to bring the holder 66 to its operating position when the cartridge is inserted fully, without the aid of the spring 199. The actuators 201 cooperating with cam faces 202' are sufficient to bring the holder 66 to its open position during removal of the cartridge 54. The spring 199 is useful is bring the holder 66 either into its fully open position or its fully closed position and hold the holder in either position.

Figure 15:
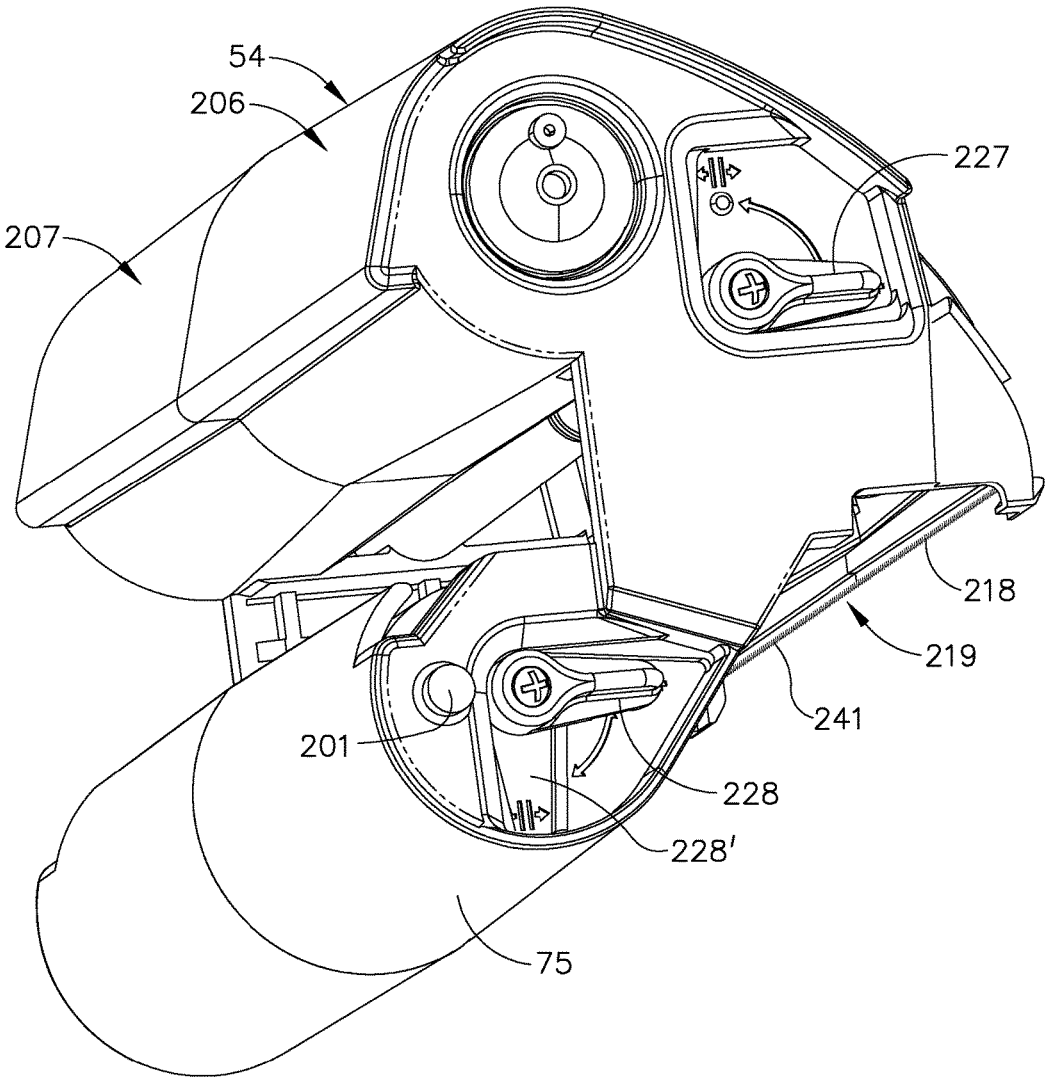
FIG. 15 is a pictorial view of the ink ribbon cartridge.
Figure 16A:
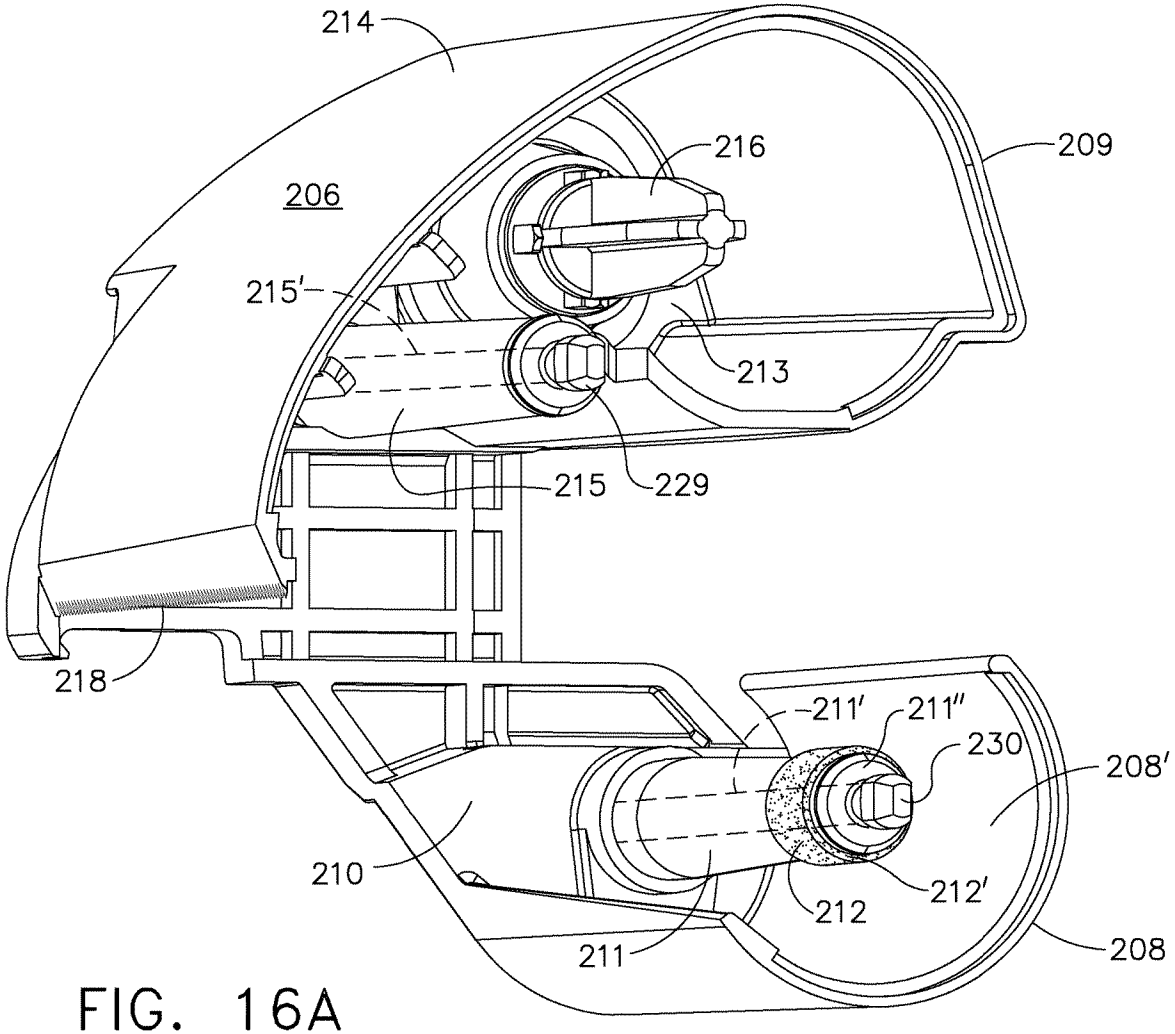
FIG. 16A is a pictorial view of one portion of the ink ribbon cartridge.
Figure 16B:
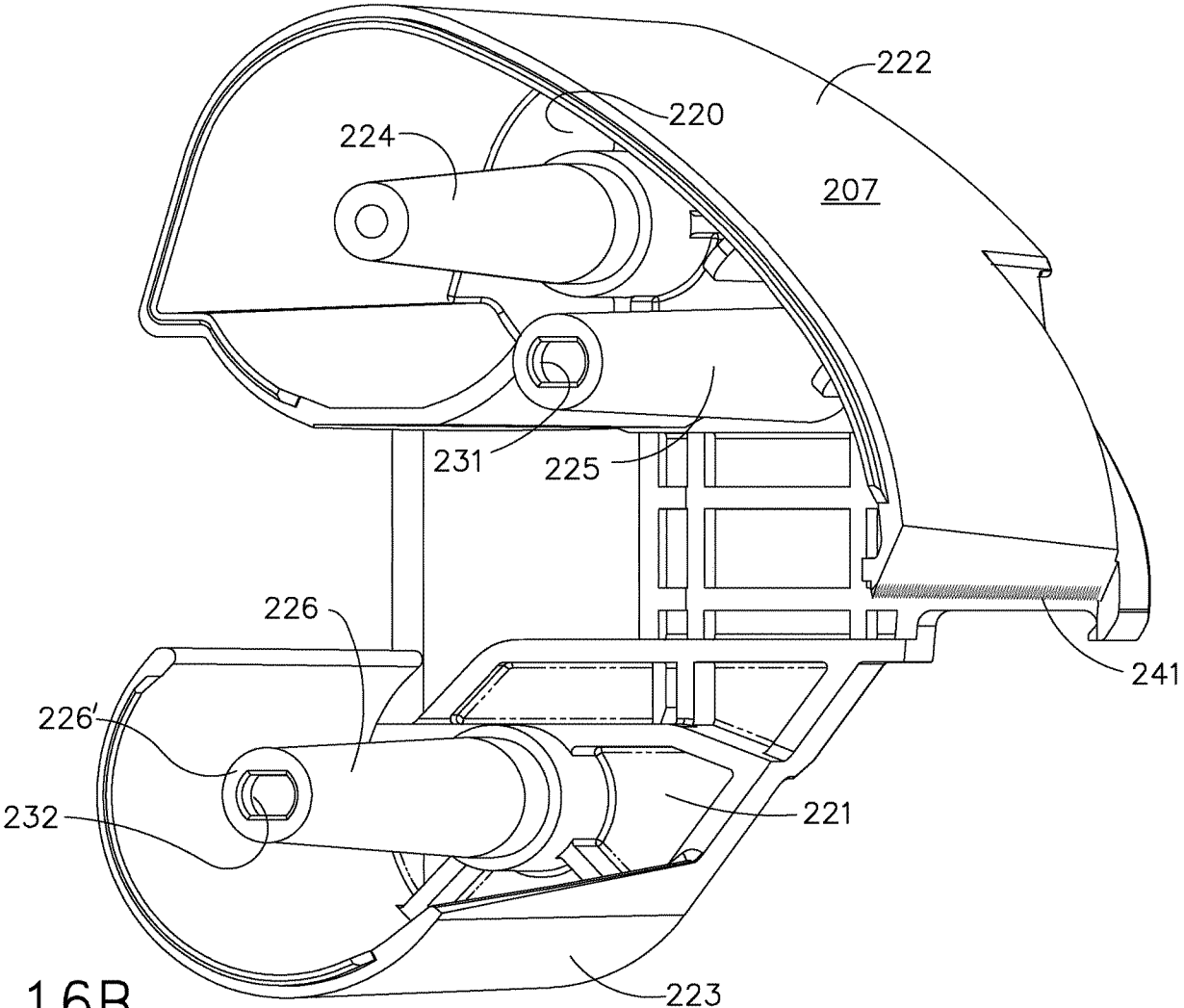
FIG. 16B is a pictorial view of another portion of the ink ribbon cartridge.

FIGS. 15, 16A and 16B show that the cartridge 54 has a frame or housing 75 which can have frame or housing sections 206 and 207. The frame sections 206 and 207 are preferably of one-piece construction. The frame section 206 has a supply roll mounting portion 208 and a take-up roll mounting portion 209. The supply roll mounting portion 208 can have an arcuate frame wall 208'. The arcuate shape is preferred for strength and to more fully enclose the supply roll SR, however, more open shapes can be provided instead. The wall 208' is integral with a side wall 210 and has a post 211 which rotatably mounts a shaft 211'. The position of the shaft 211' which extends beyond the post 211 receives an annular, axially compressible and radially expandable elastomeric brake sleeve 212. The side wall 210 is connected to a side wall 213 of the take-up roll mounting portion 209. The section 206 can have an arcuate frame wall 214 if desired and post 215 joined to the wall 213. The post 215 rotatably mounts a shaft 215'. The posts 211 and 215 are generally parallel. A rotatable spindle 216 can grip the take-up roll core 78' to wind up the take-up roll TR and thereby advance the ink ribbon I. The spindle 216 is coupled to a driver 217 (FIG. 10) when the cartridge 54 is in the operating position in the printer 50. A clutch 245 (FIG. 17) attempts to advance the ink ribbon I faster than the ink ribbon I is advanced by the platen roll 68 to maintain tension in the ink ribbon I between the platen roll 68 and the take-up roll TR. The portion 206 of the cartridge frame is shown to have a tear edge portion 218 of a tear edge 219 (FIG. 15 for example).

With reference to FIG. 16B, the frame section 207 includes a side wall 220 joined to a side wall 221. The section 207 can also have arcuate frame walls 222 and 223 joined to the respective side walls 220 and 221. The posts 224 and 225 are joined to the side wall 220 and a post 226 is joined to the side wall 221. The post 224 is axially aligned with the spindle 216, the post 225 is axially aligned with the post 215, and the post 226 is axially aligned with the post 211. The shaft 215' is connected to a handle 227 (FIG. 15) which is detentable in two alternative positions. The shaft 211' is connected to a handle 228. The shaft 215' has a non-circular projection 229 and the shaft 211' has a non-circular projection 230. The projection 229 can be received in a non-circular hole 231 in the post 225 and the projection 230 can be received in a non-circular hole 232. When the handles 227 and 228 are in their locked positions shown in FIG. 15, the projections 229 and 230 are in the hollows of posts 225 and 226 out of alignment with holes 231 and 232. The projections 229 and 230 extend beyond the holes 231 and 232 into hollow interior space in the posts 225 and 226. When the handle 228 is moved to its unlocked positions at a right angle to the position shown, the handle 228 falls into a recess 228' which relieves the compression force against the end 212' of the brake sleeve 212 exerted by flange 211" on the shaft 211' in the locked condition shown in FIG. 15. For further details reference may be had to the ink ribbon cartridge shown in U.S. Pat. No. 5,597,249.

As shown, the frame section 207 has a tear edge portion 241 aligned with the tear edge portion 218 of the tear edge when the frame sections 206 and 207 are assembled to provide a tear edge 219 that extends at least as long as the widest web W between gripper arms 63. The walls 214 and 222 terminate at respective tear edge portions 218 and 241. The tear edge 219 can be used to tear off the web C or the carrier web W in the strip mode in which the web C or the web W is fed out through the exit opening 70. In the peel mode, of course, the carrier web W passes about the delaminator 69 and between the platen roll 68 and the back-up roll 71 and from there the web W passes out of the exit opening 72. Lower edge of the toggle member 74 also has a tear edge 74' (FIG. 3 for example) for tearing of excess carrier web W that extends beyond the exit opening 72.

With reference to FIG. 17, there is shown the drive mechanism 81 which is essentially the same as the drive mechanism in U.S. Pat. No. 5,597,249, except for example a guide slot 260 (FIG. 18) in the mounting plate 242'. FIG. 17 shows the electric motor 242 mounted on a stand off 243. Gearing generally indicated at 244 drives the toothed driver 217 (FIG. 5) through a clutch 245 which may be of the wrapped-spring type if desired. The gearing 244 includes a compound gear 246 which includes a gear 247 rigidly coaxially connected to a gear 248. The gear 247 meshes with a pinion on the motor shaft (not shown). The pinion on the motor shaft also drives a compound gear 249 which drives a gear 249' and in turn a gear 250 which is part of the clutch 245.

Figure 18:
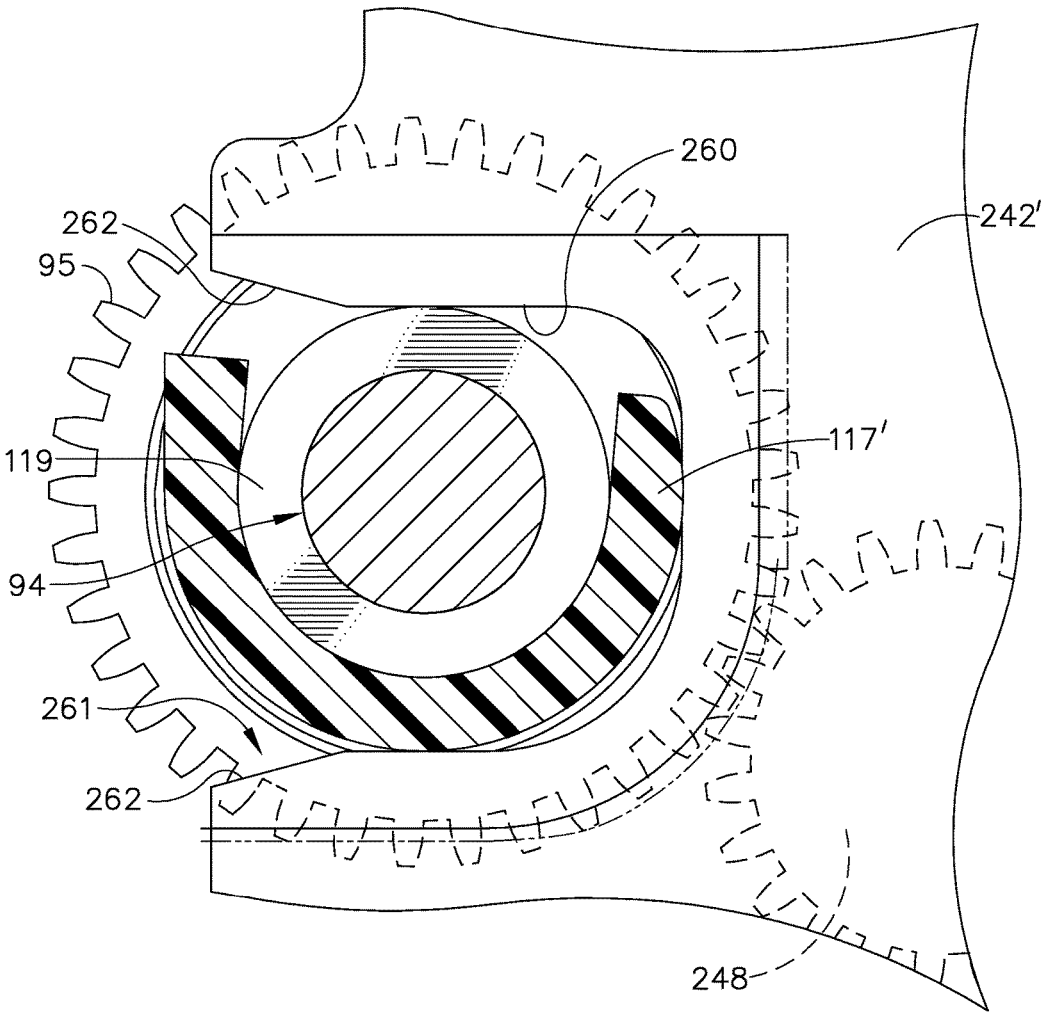
FIG. 18 is an enlarged, partly sectional view showing the manner in which the platen gear is held in position with respect to the driving gear.

FIG. 18 shows the mounting plate 242' as having an open-ended slot 260 which receives the bearing socket 117' and the outboard bearing 119. The slot 260 thus captures the bearing socket 117' and the bearing 119 and promotes proper meshing of the gear 95 and the gear 248. The housing section 169 has an open-ended slot 169' (FIG. 10) which is larger than the slot 260 so that neither the shaft 94 nor socket 117 controls the alignment of the gear 95 with the gear 248. It is rather the slot 260 alone which controls the meshing of the gears 95 and 248. It is noted that when the door 53 is closed the socket portion 117' preferably bottoms in the slot 260, as shown. The slot 260 has a converging entry 261 with tapers 262 at both sides adjacent the opening in the slot 260 to guide the socket portion 117' and the bearing 119 into the slot 260 when the door 53 is moved to the closed position.

Figure 20:
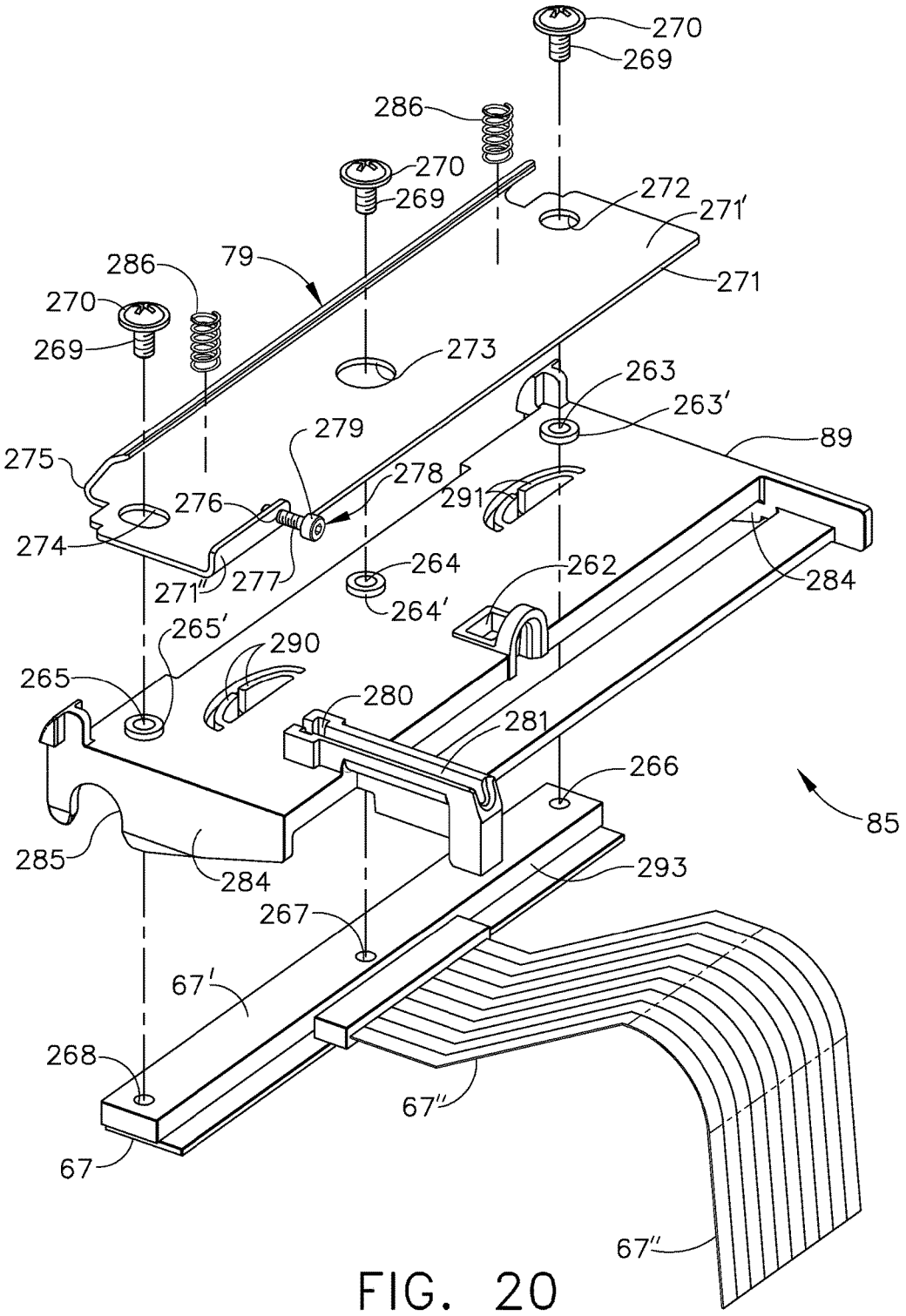
FIG. 20 is an exploded pictorial view of the print head assembly.
Figure 21:
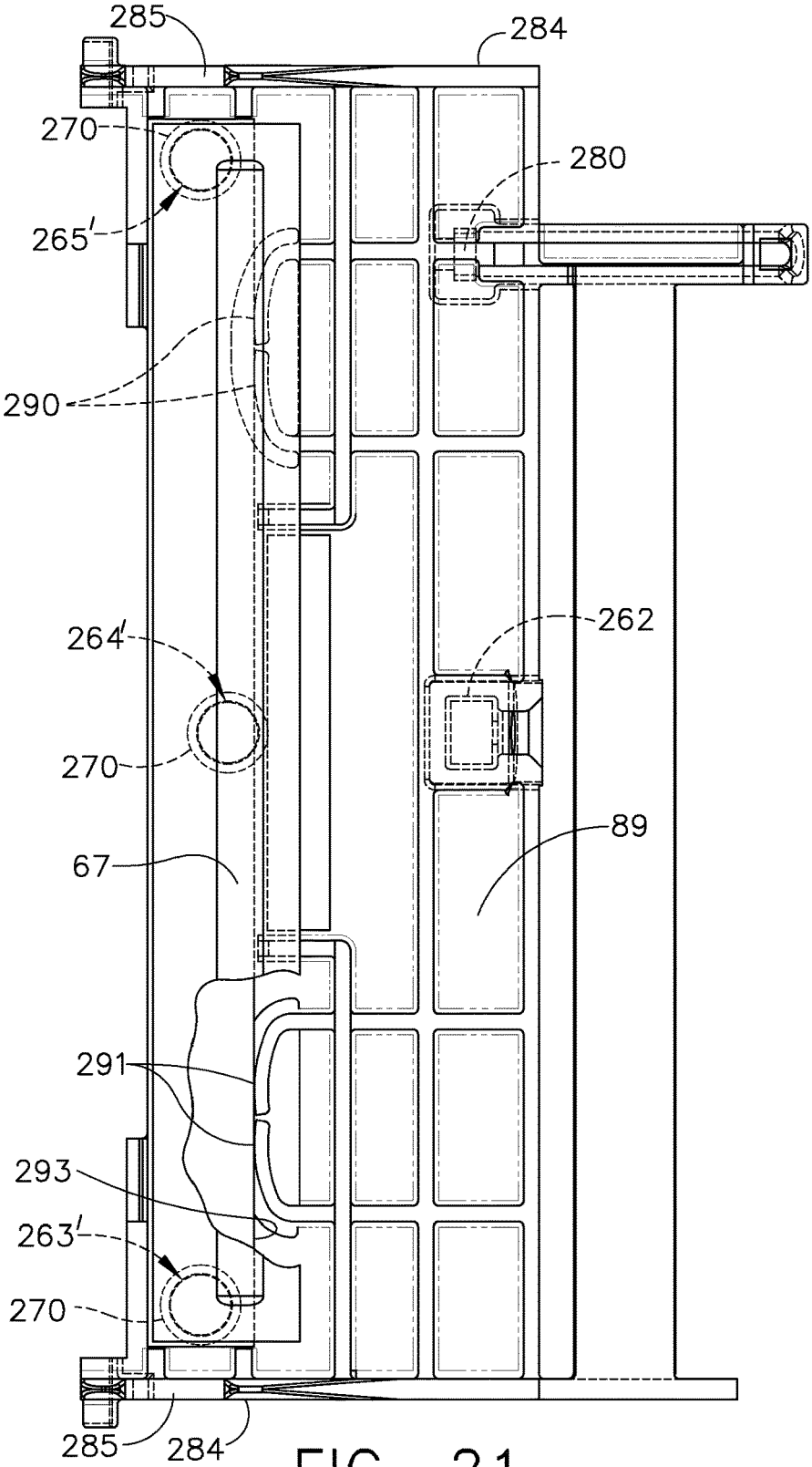
FIG. 21 is a bottom plan view of the print head assembly.
Figure 22:
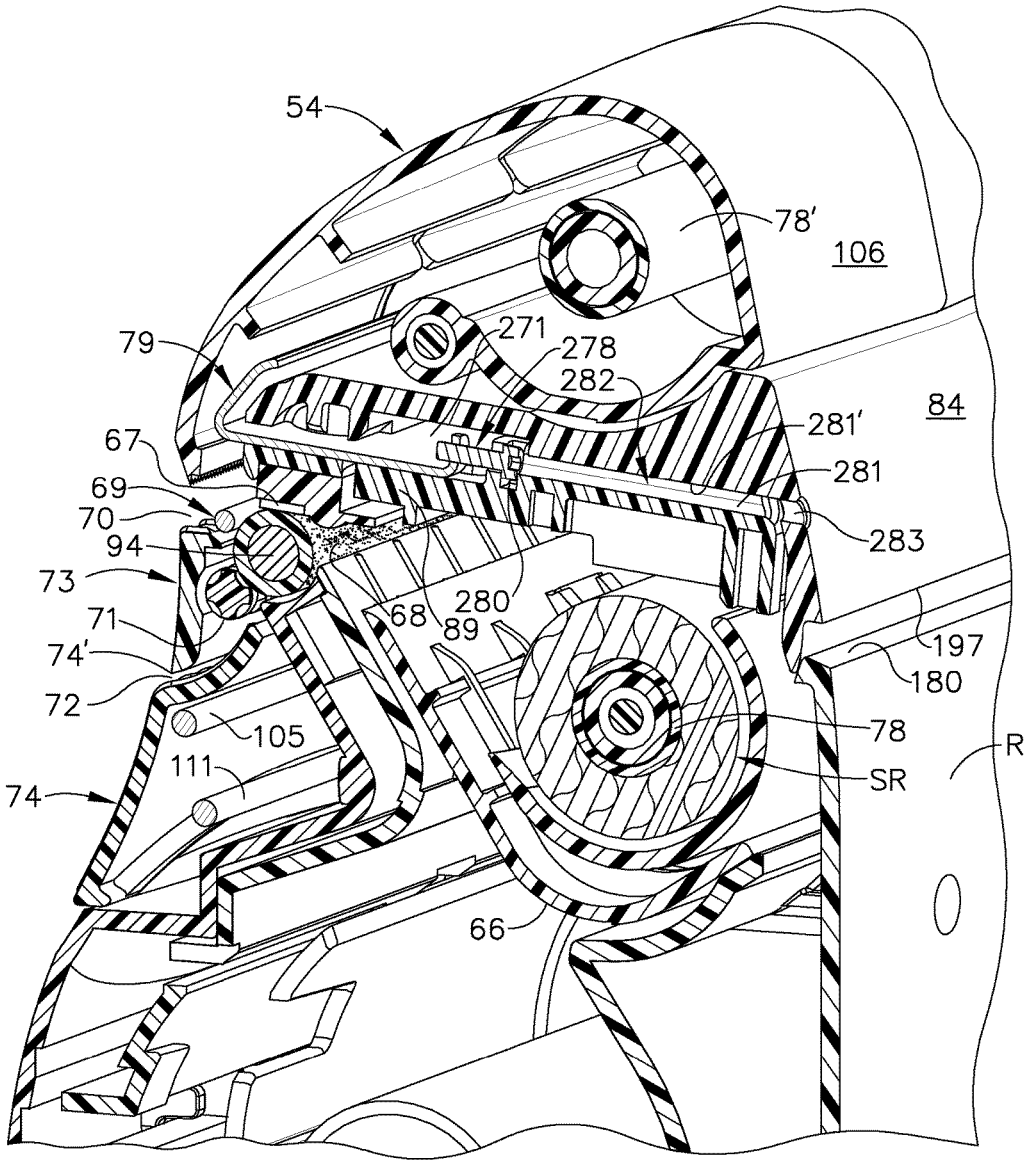
FIG. 22 is a sectional pictorial view through the upper portion of the printer.

With reference to FIG. 20, there is shown the print head assembly 85 which may include support or mounting plate 89 having a socket 262 for receiving the post 86 (FIG. 3 for example). The socket 262 and the post 86 enable the support 89 to pivot or gimbal to enable the print head 67 to accommodate to the platen roll 68. The print head 67 is mounted on the underside of a metal plate or heat sink 67' which helps dissipate heat from the print head 67. The support 89 is shown to have preferably three holes 263, 264 and 265. The holes 263, 264 and 265 are aligned with respective threaded holes 266, 267 and 268 in the heat sink 67'. However, the holes 263, 264 and 265 are unthreaded and may be slightly larger in diameter than the shanks 269 of screws 270. The ribbon guide 79 which may be in the form of a guide plate 271 having a generally planar or plate-like portion 271' having three holes 272, 273 and 274. The hole 272 is round and makes a rotatable fit around a boss 263' surrounding the hole 263. The hole 273 is oversize with respect to the boss 264' and receives the boss 264' that surrounds hole 264. The hole 274 is elongate and receives the boss 265' which surrounds the hole 265. A screw 270 passes through holes 272 and 263 and is threadably received in the hole 266. A screw 270 passes through holes 273 and 264 and is threadably received in the hole 267, and a screw 270 passes through the holes 274 and 265 and is threadably received in the hole 268. The guide 79 has a curved portion 275 which is at least as wide as the ink ribbon I and is joined to the planar portion 271'. The guide 79 also includes a flange 271" with a threaded hole 276 to receive a threaded shank 277 of an adjusting screw 278. The screw 278 can preferably have a socketed head 279 with an Allen socket to receive an Allen wrench (not shown). The head 279 is received in a socket 280 molded integrally with the support 89. A groove 281 aligned with the head 279 in the socket 280 serves as a guide for the Allen wrench. As shown, the groove 281 is open at both ends and one end opens into the socket 280. The screw 278 is able to rotate but is not able to translate. Rotation of the screw 278 will cause the guide 79 to pivot about the boss or pivot 263' to adjust the guide 79. FIG. 22 shows that the groove 281 shown in FIG. 20 comprises only one-half the opening 282 through which an Allen wrench can extend. The other half of the opening 282 is comprised of an end wall 281' in the support 84. The opening 282 is aligned with an access opening 283 in the support 84. While the printer of U.S. Pat. No. 5,597,249 had a guide which was adjustable it was not possible to adjust the guide while the printer was advancing the record member web or the ink ribbon. It was necessary to stop operation of the printer, adjust the guide, restart the printer and possibly re-adjust the guide again, and so on until adjustment and wrinkle-free advance of the ink ribbon was attained. In the embodiment of the present invention, the web C and the ink ribbon I can be advanced upon rotation of the platen roll, and the guide 79 can be adjusted while the ink ribbon I is advancing.

Figure 12A:
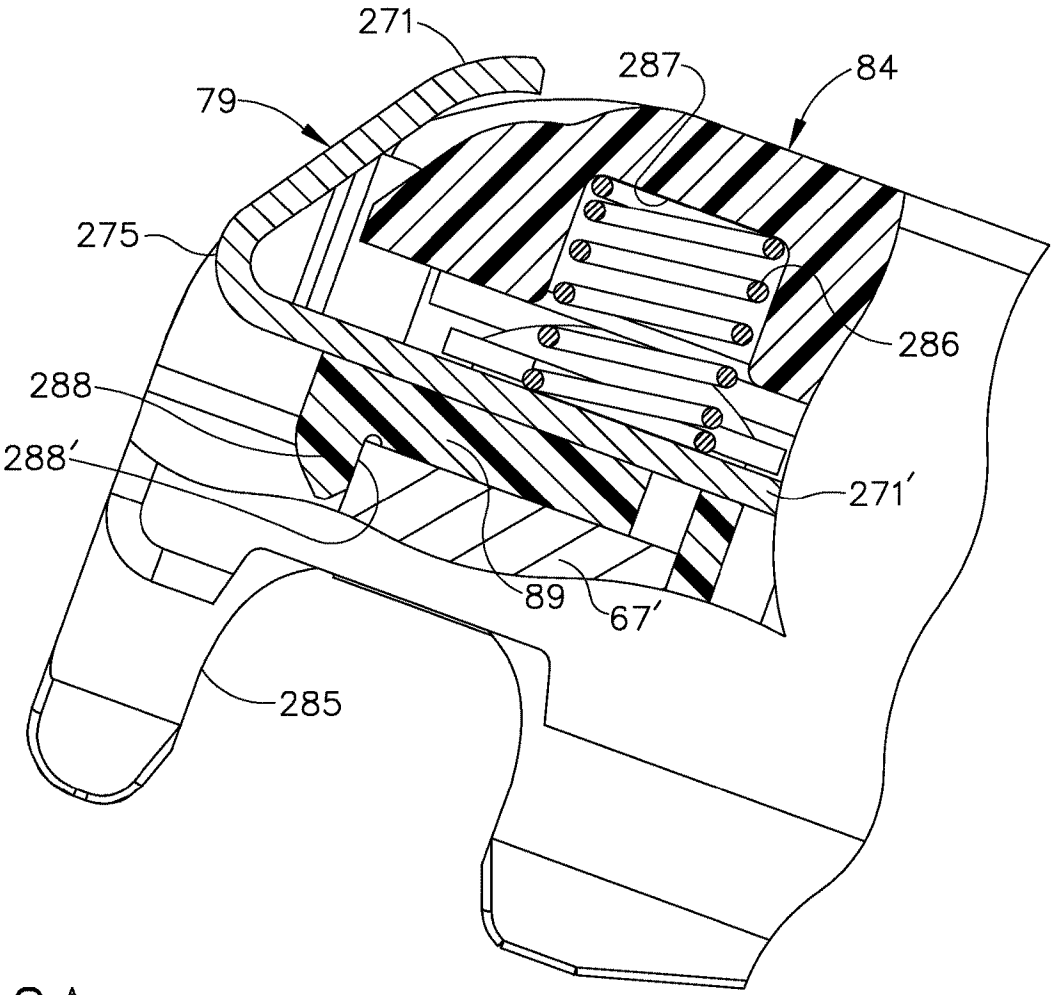
FIG. 12A is an enlarged sectional view of a portion of the printer shown in FIG. 12.
Figure 19:
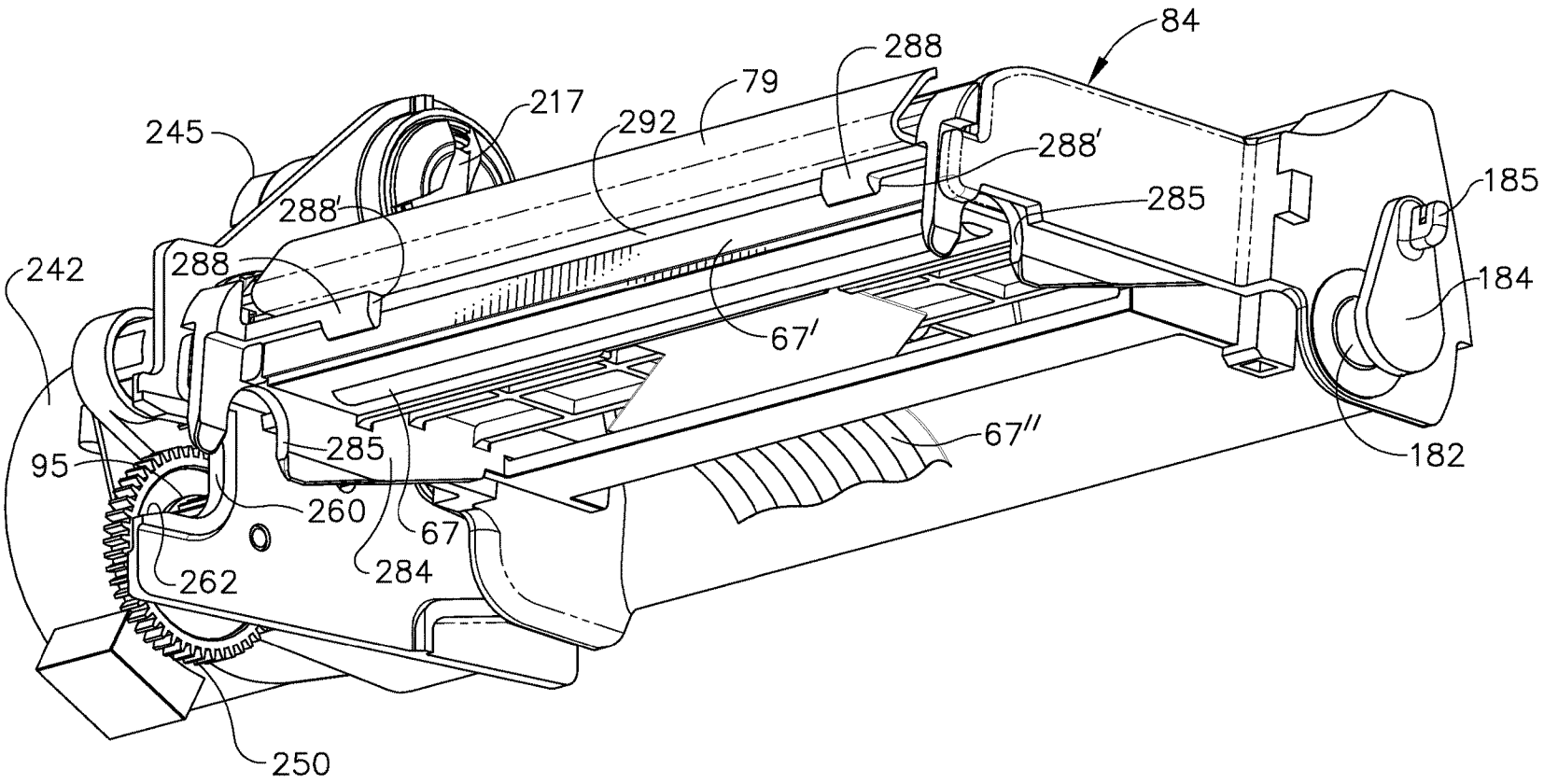
FIG. 19 is a pictorial view showing the manner in which the print head assembly is mounted.

The support or mounting member 89 includes a pair of depending flanges 284, each having a locating or guide slot 285 (FIG. 19). Springs 286 (FIG. 20), resting in respective pockets 287 (one of which is shown in FIG. 12A) in the support 84, bear against the flat panel 271' of the guide plate 271. When the cartridge 54 is in position and the toggle mechanism 62 is closed or latched, the toggle mechanism 62 causes the cartridge 54 to exert force against the support 84. FIG. 9 shows pairs of stops 117*a* and 118*a*. The support 84 has a pair of stop faces 84*a* and 84*b* which abut the respective stops 117*a* and 118*a* when the support 84 is in the operating position. When the support 84 is in its operating position the springs 286 are compressed to exert just the right amount of printing operating pressure or force against the ink ribbon I and the composite web C and against the platen roll 68 for effective thermal printing. It is noted that surface 292 of the heat sink 67' is located on the support 89 against a pair of locating surfaces 288' on locators 288. Two pairs of spring fingers 290 and 291 exert pressure against surface 293 of the heat sink 67'. This insures accurate positioning of print head 67 with respect to alignment slots 285.

Figure 23:
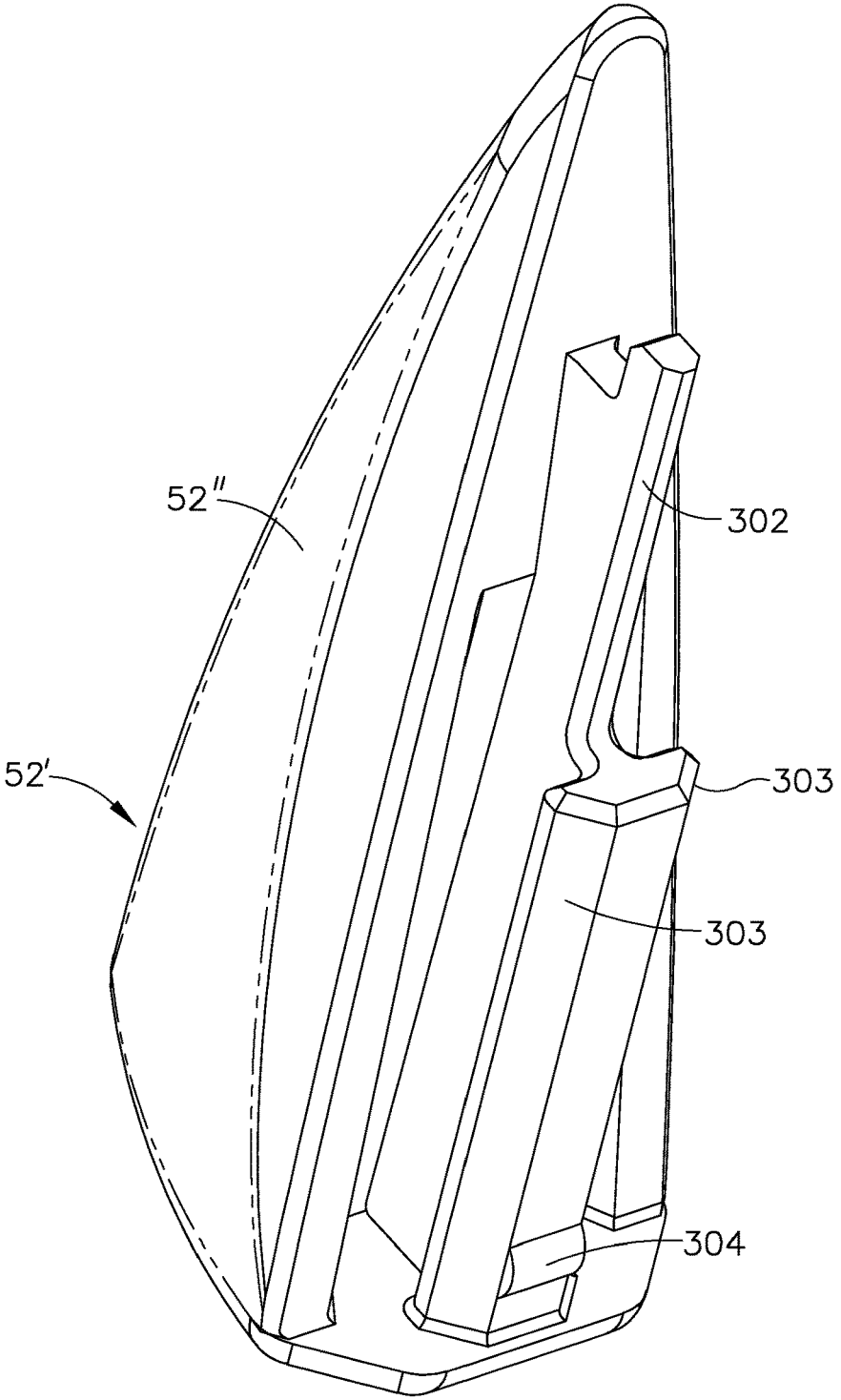
FIG. 23 is a pictorial view of one of the bumpers which also serves as a foot for the printer.
Figure 24:
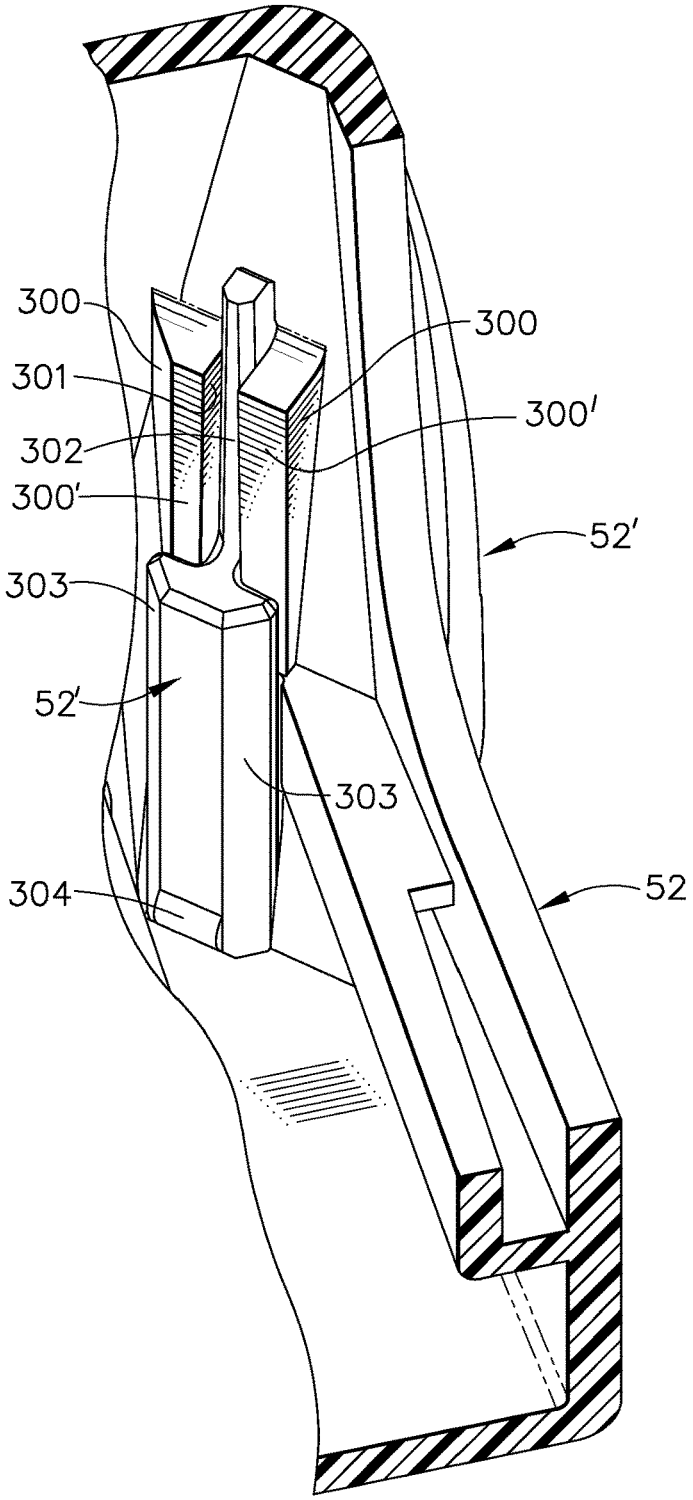
FIG. 24 is a pictorial view showing the bumper assembled onto the main printer housing.
Figure 25:
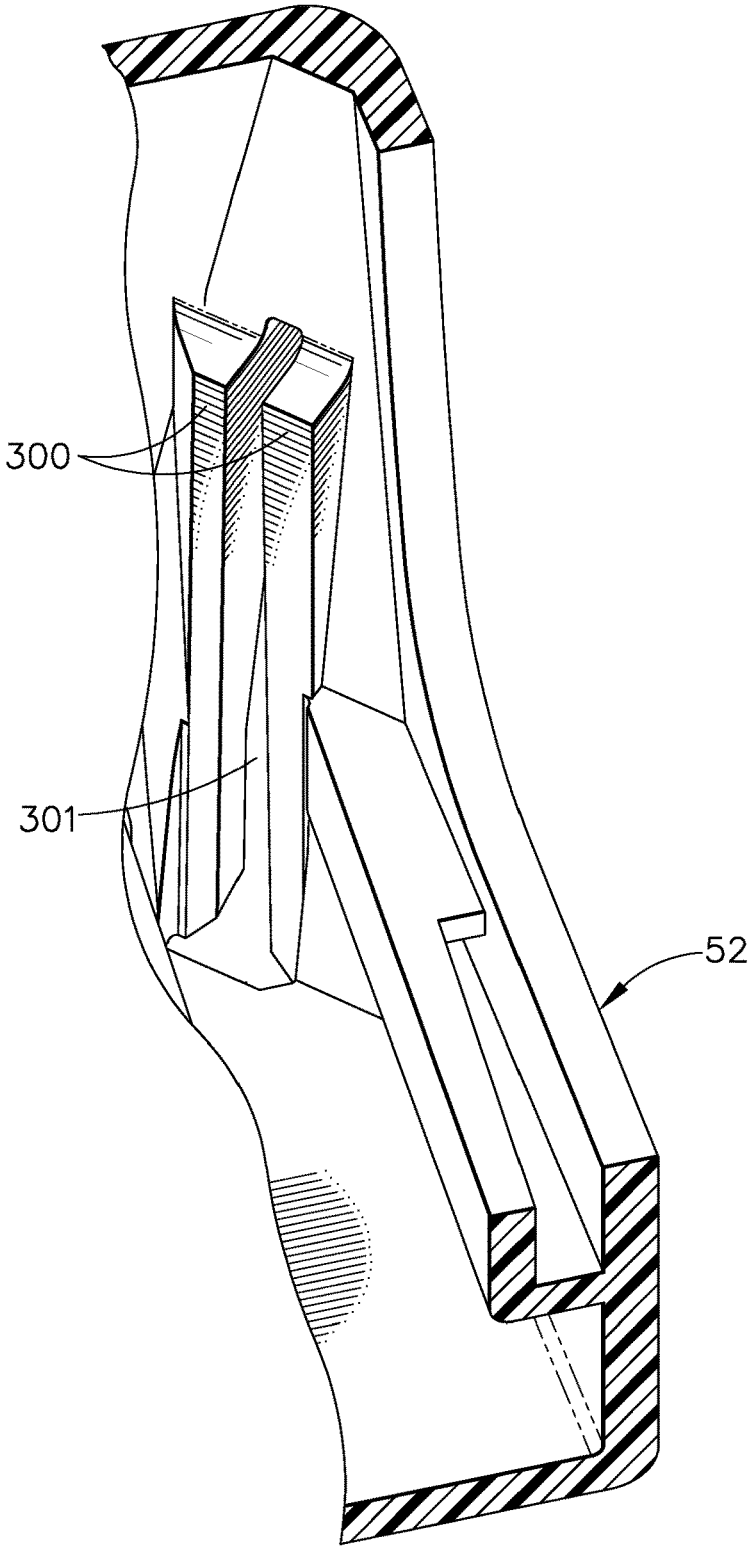
FIG. 25 is a sectional view showing a portion of the main printer housing.
Figure 26:
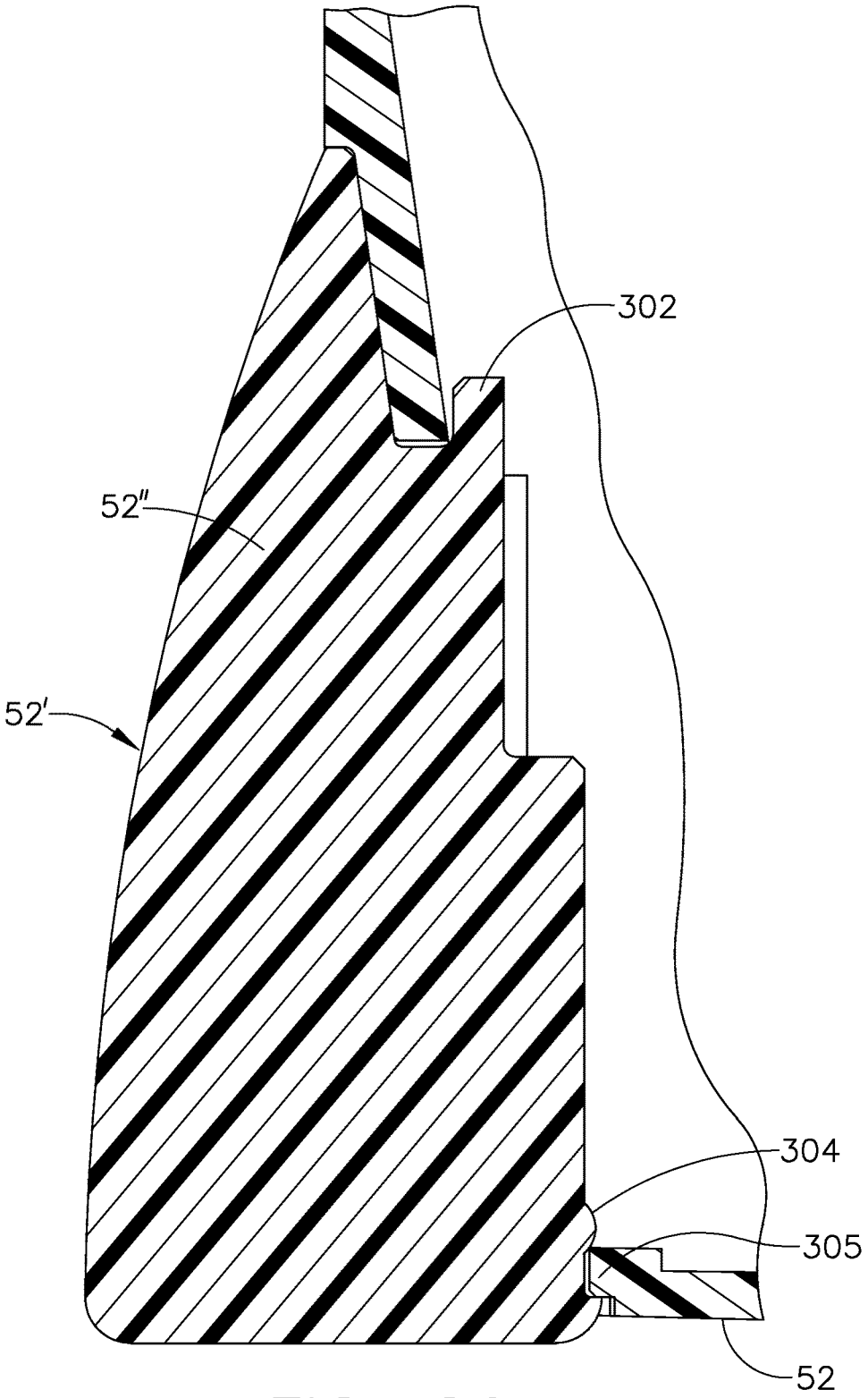
FIG. 26 is a sectional view showing the manner in which the bumper or foot is held captive in the main printer housing.

With reference to FIG. 23, there is shown one of the resilient, elastomeric bumpers 52', in particular a foot which can be attached to the housing section 52 easily during manufacture and which can be removed if desired. The four feet 52' are shown taking FIGS. 1 and 2 together. The feet 52' are preferably identical as is preferred so only one is described in detail. The foot 52' has a body 52" which is external to the housing section 52 and preferably has a triangular shape in horizontal section and the foot 52' also has a triangular shape in vertical section. The foot 52' is intended to be attached to the outside of the housing section 52, but part of the foot 52' is internal to the housing section 52. With reference to FIGS. 24 and 25, the housing section 52 has a pair of spaced internal ribs 300 which straddle an opening or slot 301. The foot 52' has an elongate portion 302 received in the slot 301 and a pair of flanges 303 which contact inner faces 300' of the ribs 300. The flanges 303 capture the foot 52'. The bumper 52' has a projection 304 which cooperates with a projection 305 on the housing section 52 (FIG. 26) to prevent retrograde movement of the foot 52' out of the slot 301.

Figure 27:
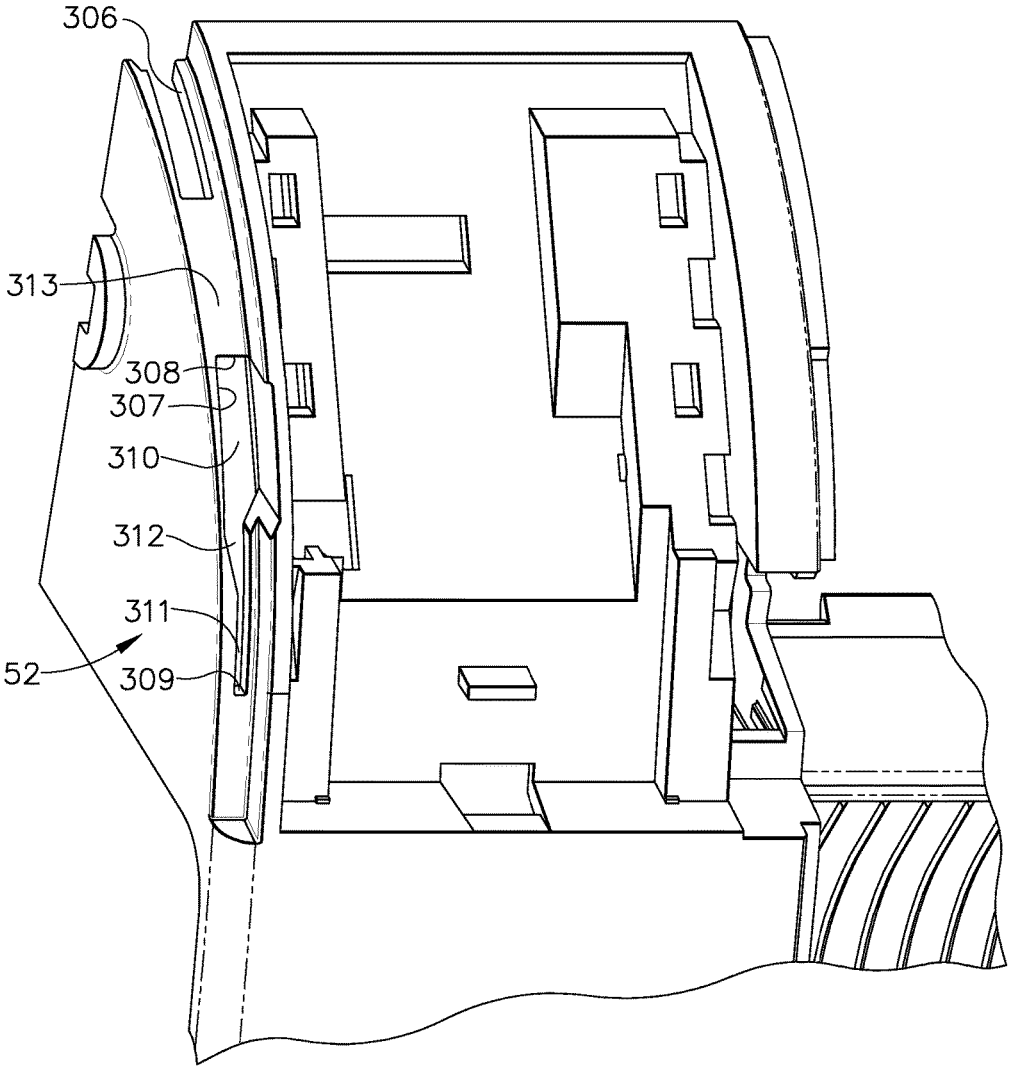
FIG. 27 is a pictorial view showing a slot in the front portion of the main housing into which a bumper can be inserted.
Figure 28:
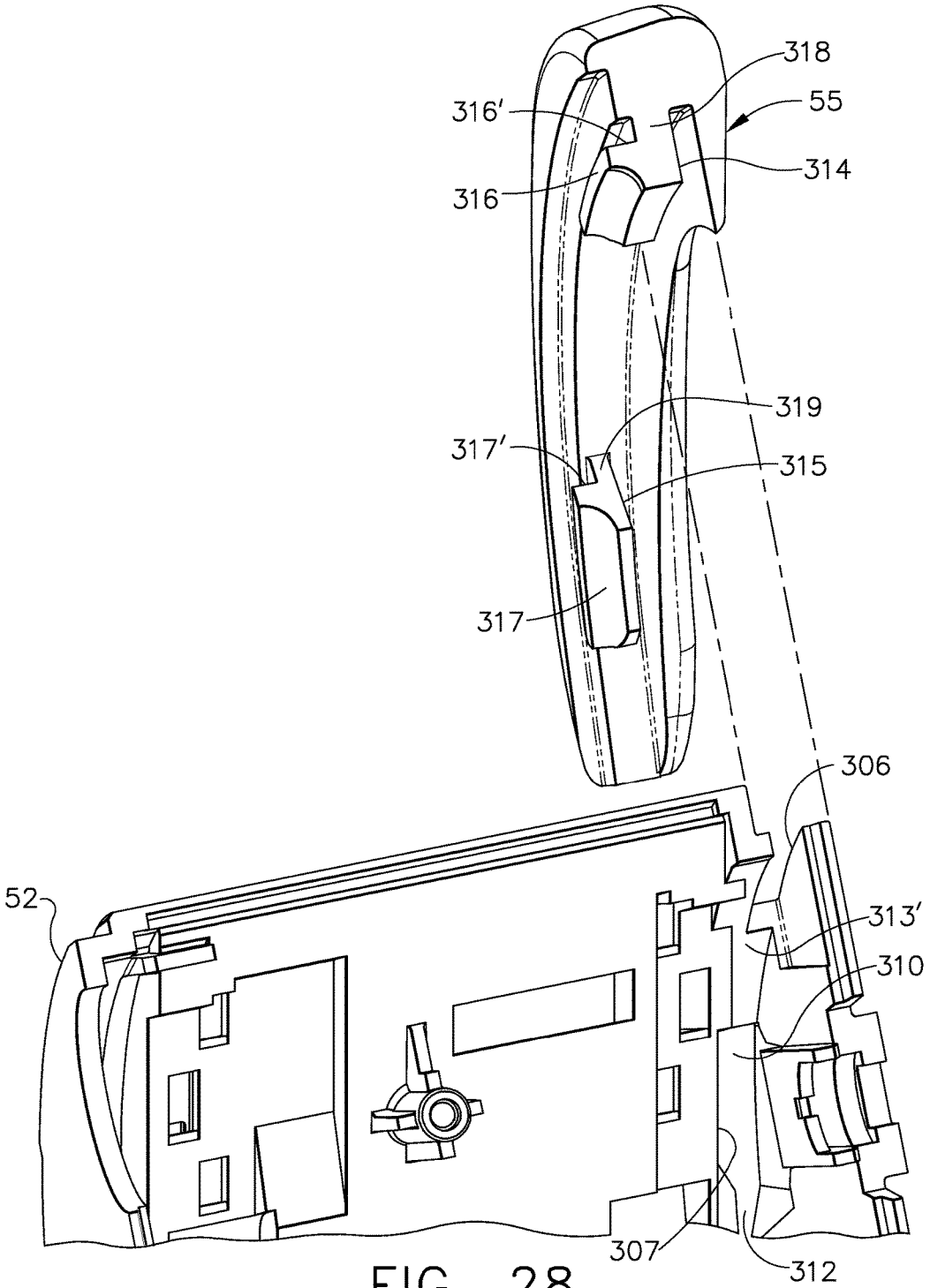
FIG. 28 is an exploded pictorial view showing the front portion of the housing depicted in FIG. 27 into which a bumper can be inserted.
Figure 29:
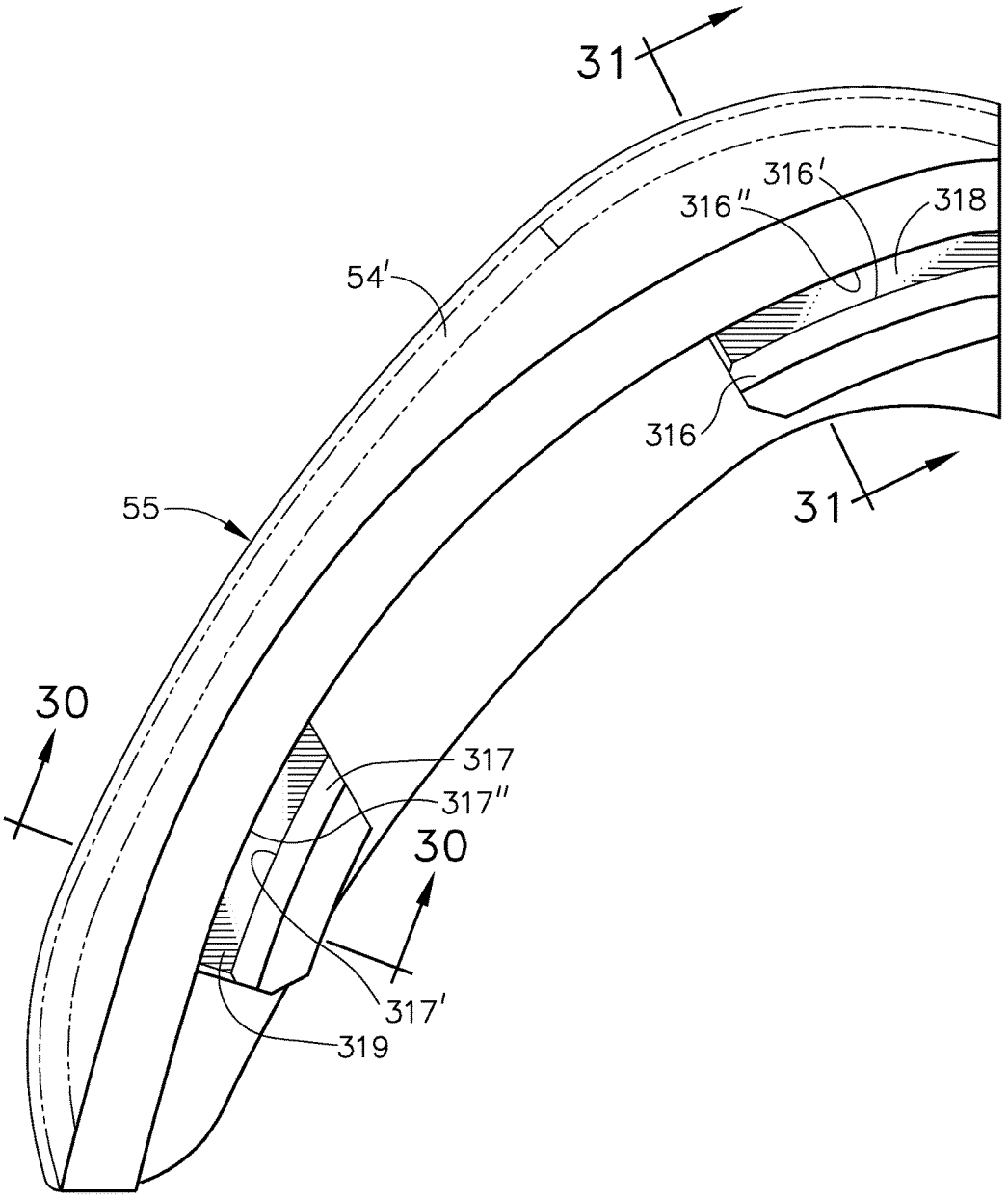
FIG. 29 is a pictorial view of the bumper shown in FIG. 28.
Figure 30:
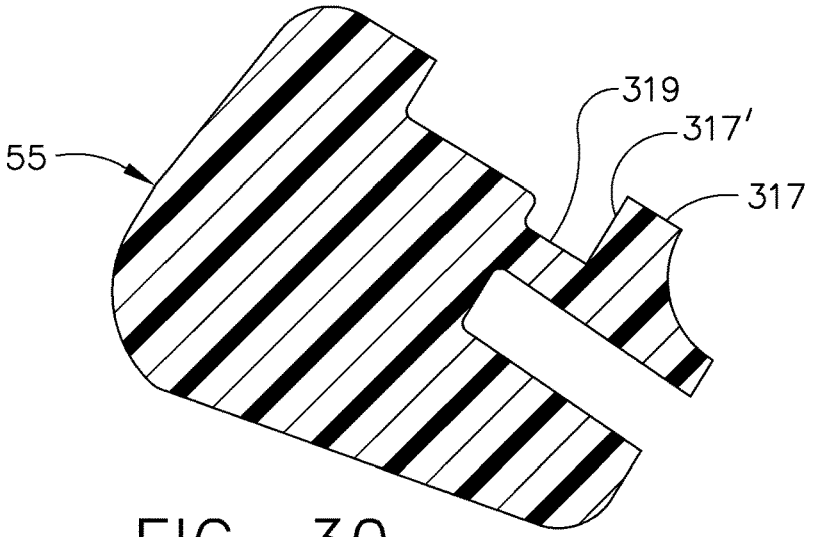
FIG. 30 is a sectional view taken along line 30-30 of FIG. 29.
Figure 31:
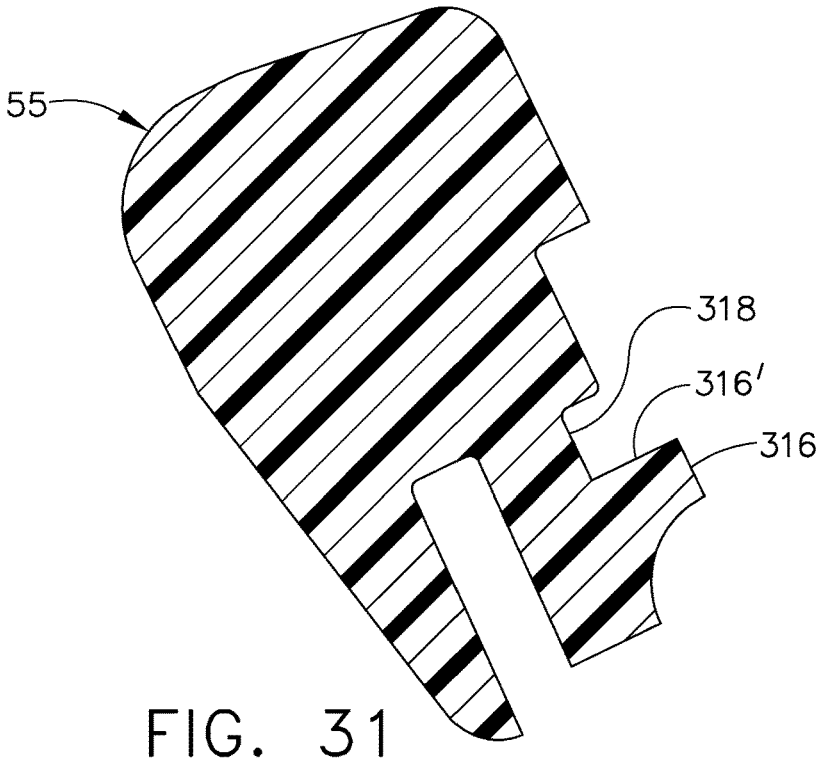
FIG. 31 is a sectional view taken along line 31-31 of FIG. 29.

With reference to FIG. 27, there is shown a portion of the housing section 52 with slots 306 and 307 by which a front bumper 55 can be attached. The slot 306 is open-ended, while the slot 307 has closed ends 308 and 309. The slot 306 may have a constant width as shown, and the slot 307 has a wide portion 310 and a narrow portion 311 joined by a converging portion 312. FIG. 28 shows the bumper 55 as having an arcuate shape to fit the outer profile of the arcuate-shaped corner portion 313 (FIG. 27) of the housing section 52. The underside of the bumper 55, that is, the portion at the inner side of the bumper 55 has two flexible, cantilevered projections 314 and 315 having respective flanges 316 and 317. To attach the bumper 55 to the curved corner 313, the projection 315 is inserted into the wide slot portion 307. In this position of the bumper 55, the projection 314 is slightly beyond the open end of the slot 306. Next the bumper 55 is slid along the arcuate portion 313 so that a relatively wide neck 318 of the projection 314 enters the slot 306 and a relatively narrow neck 319 of the projection 315 starts moving along the converging slot portion 312. When the neck 319 reaches the slot end 309 (FIG. 27) the bumper 55 is in place and the flanges 316 and 317 are against an inner surface 313' of the housing 52 adjacent slot 306 and slot portion 311, respectively. The resilient elastomeric material of the bumper 55 frictionally grips the arcuate portion 313 adjacent the slots 306 and 307, partly due to the close fit between the necks 318 and 319 and upper sides 316' and 317' and the underside 313' of the arcuate portion 313.

Figure 32:
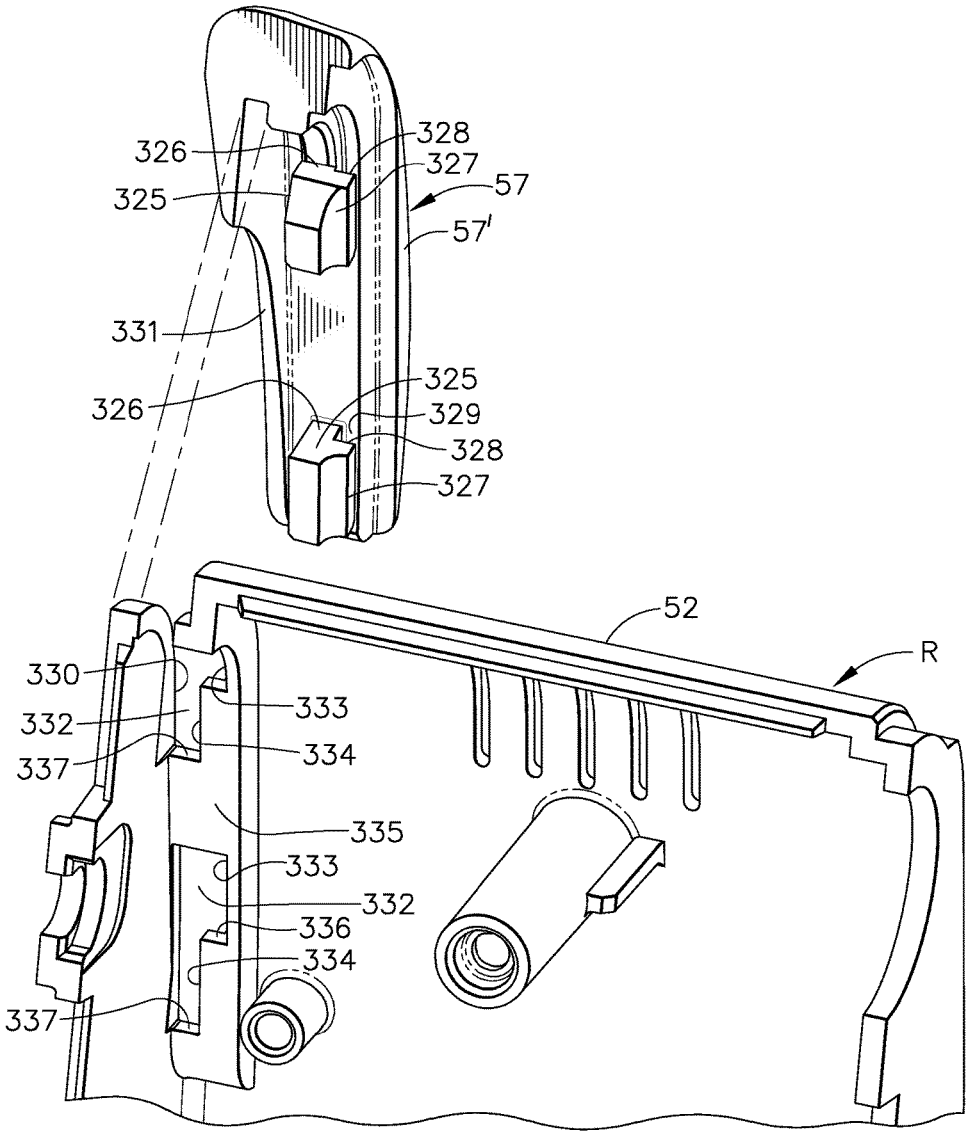
FIG. 32 is an exploded pictorial view of a bumper at the rear portion of the housing.
Figure 33:
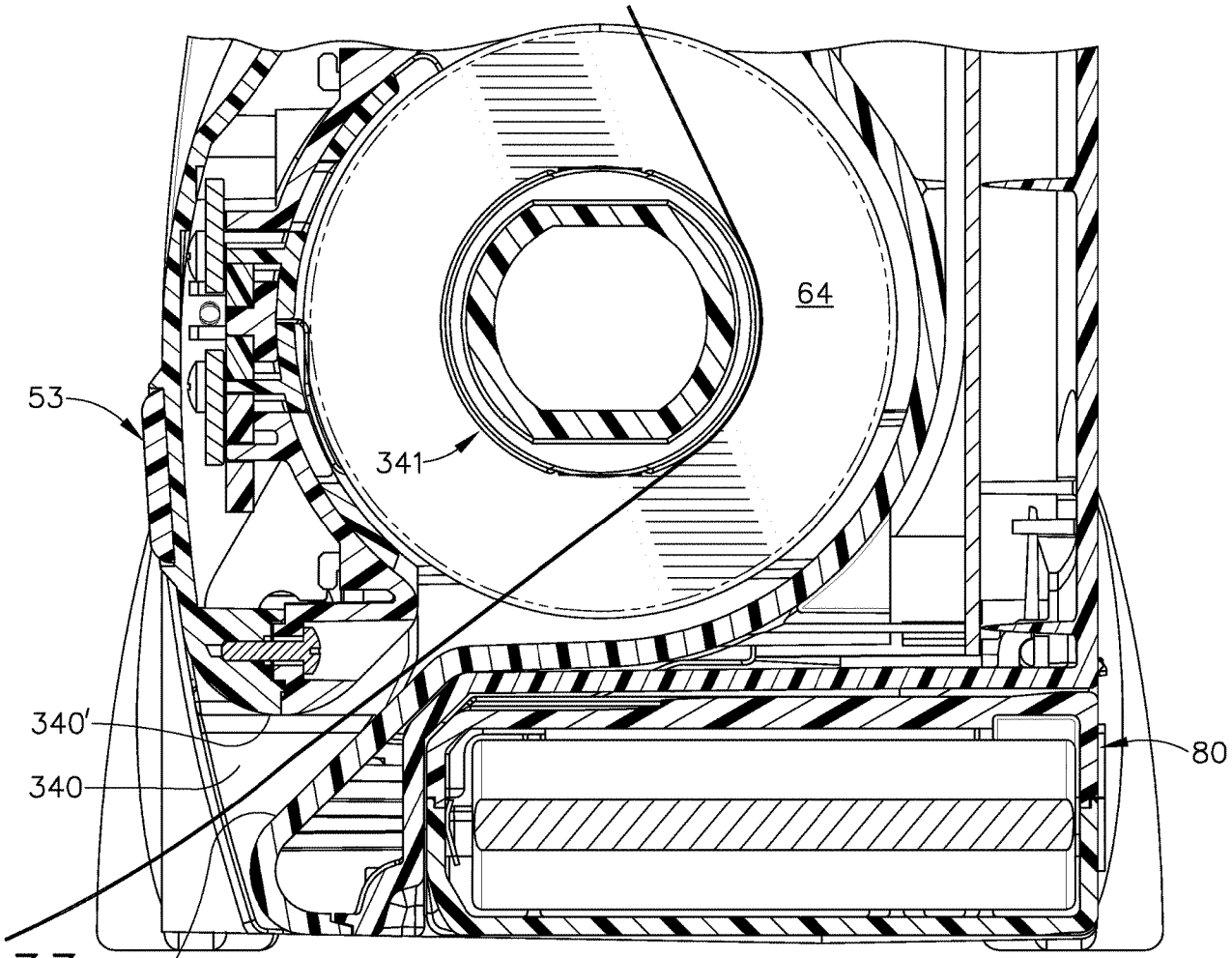
FIG. 33 is a sectional view of the lower portion of the printer with a guide for guiding a record member web in a fan-fold mode.

FIG. 32 shows the bumper 57 with preferably two substantially identical, spaced, cantilevered, internal projections 325, each including a neck 326 and a flange 327 with a face 328. The face 328 overhangs a face 329 on the bumper body 57'. The housing section 52 has a curved external corner portion 330 protected by the bumper 57. The bumper body 57' has a flange 331 which covers the left side of the housing section 52. The remainder of the body 57' covers the top of the housing section 52. The housing section 52 has slots 332 each of which as an enlarged slot portion 333 and a reduced slot portion 334. To couple the bumper 57 to the housing section 52, the projections 325 are lined up with respective enlarged slot portions 333 and pushed inwardly until the faces 328 are in line with the inside surface 335 of wall 336 of the housing section 52. Then the bumper 57 is slid downwardly and rearwardly as viewed in FIG. 32 until the necks 326 abut against bottoms 337 of the slots 332, whereby the bumper 57 is captive in the slots 332 in the housing section 52 with the housing wall 336 between faces 328 and 329.

With reference to FIGS. 33 through 36, there is shown an arrangement by which a fan-folded web of a composite web C or a web of tags (not shown) can be utilized by the printer 50. The lower portion of the door 53 is provided with a converging throat 340 provided by guide surfaces 340' which provide entry into the space 64 normally used to contain the record member supply roll R'. The space 64 is bounded by surfaces 66*a*, 66*b* and 66*c* (FIG. 2). From there the composite web C, or the web of tags, as the case may be, is guided by a guide generally indicated at 341 and from there the web C is guided to between the print head 67 and the platen roll 68.

Figure 34:
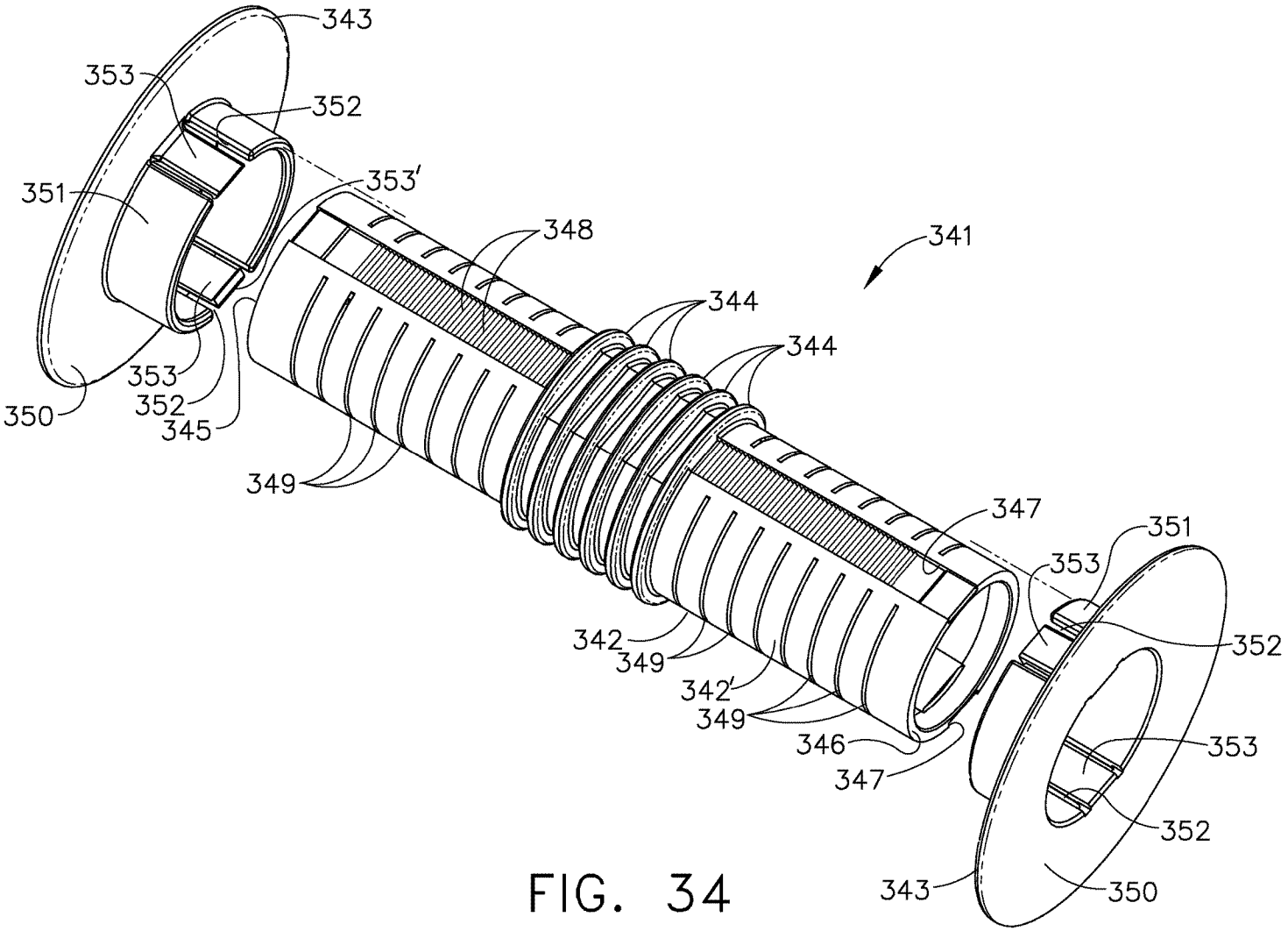
FIG. 34 is an exploded pictorial view of the guide also shown in FIG. 33.

FIG. 34 shows the guide 341 as including a preferably tubular shaft or tube 342 and preferably identical side edge or side guides 343. The shaft 342 has a certain outside periphery or surface at 342' with a certain diameter and one or more integral, radially outwardly extending ribs or web-contacting guide members 344. The set of members 344 is preferably midway between terminal ends 345 and 346 of the shaft 342. The shaft 342 has diametrically opposed, longitudinally extending grooves 347. The grooves 347 in turn contain laterally extending closely spaced ridges 348 best shown in FIGS. 35 and 36 disposed on opposite sides of the guide members 344. The outer surface 342' also contains peripherally extending graduations 349 at preferably equally spaced or selected intervals at both sides of the guide members 344. Side guides 343 have disc-shaped members 350 and an annular or tubular hub 351. The hub 351 has opposed slots 352 into which at least one and preferably two diametrically opposed spring fingers or projections 353 extend. The spring fingers 353 are cantilevered to the disc 350 and each spring finger 353 has a tooth 353' to engage the shaft 342 between adjacent ridges 348 in the respective groove 347. The spring fingers 353 may have a slight inward inclination toward the tube 342 in the as-molded state. The spring fingers 353 preferably do not project outwardly beyond the outer periphery of the hub 351. It is noted that the outside diameters of the hubs 351 and the guide members 344 are preferably the same or essentially the same so that side edges of the web C are guided by the discs 350 and the marginal sides edges of the web C are supported by the hubs 351 and the guide members 344. Not only is the web C guided but the web C is well supported so that any tendency of the web C to warp or meander is eliminated. As shown in FIG. 35, end portions 354 of the shaft 342 receive the hubs 92 of the roll mounting members 91. In order to mount the shaft 342 on the roll mounting members 91, the roll mounting members 91 are manually spread apart and then the shaft 342 is aligned with the hubs 92 and released so the shaft 342 is mounted as shown in FIG. 35 center-justified with respect to the print head 67. Even though the shaft 342 is center-justified along centerline CL midway between terminal ends 345 of the shaft 342, the user may position the side guides 343 at equal distances from the ends 345 in order to achieve such center-justification. Accordingly, the graduations 349 are provided so that the user can readily position both side guides 343 at equal distances from the centerline CL, that is, at equal distances from the terminal ends 345 and 346. The graduations 349 may be grooves as shown or slightly raised or they may be printed, however, grooves as shown or ridges are preferred because they are molded-in and do not require a secondary operation to create them. If the graduations 349 are raised, the inside diameters of the hubs 351 need to be sized accordingly. The entire shaft 342 including its features such a guide members 344 is of one-piece molded plastics construction.

It is noted that according to FIG. 35 in particular the side guides 343 are assembled with the discs 350 outboard of the hubs 351. This enables the guide 341 to be used with the widest webs and some narrower webs C. However, as shown in FIG. 36, the side guides 343 can be turned around or reversed so that the web C, shown in phantom lines, can be used to guide a narrow web C.

Figure 36:
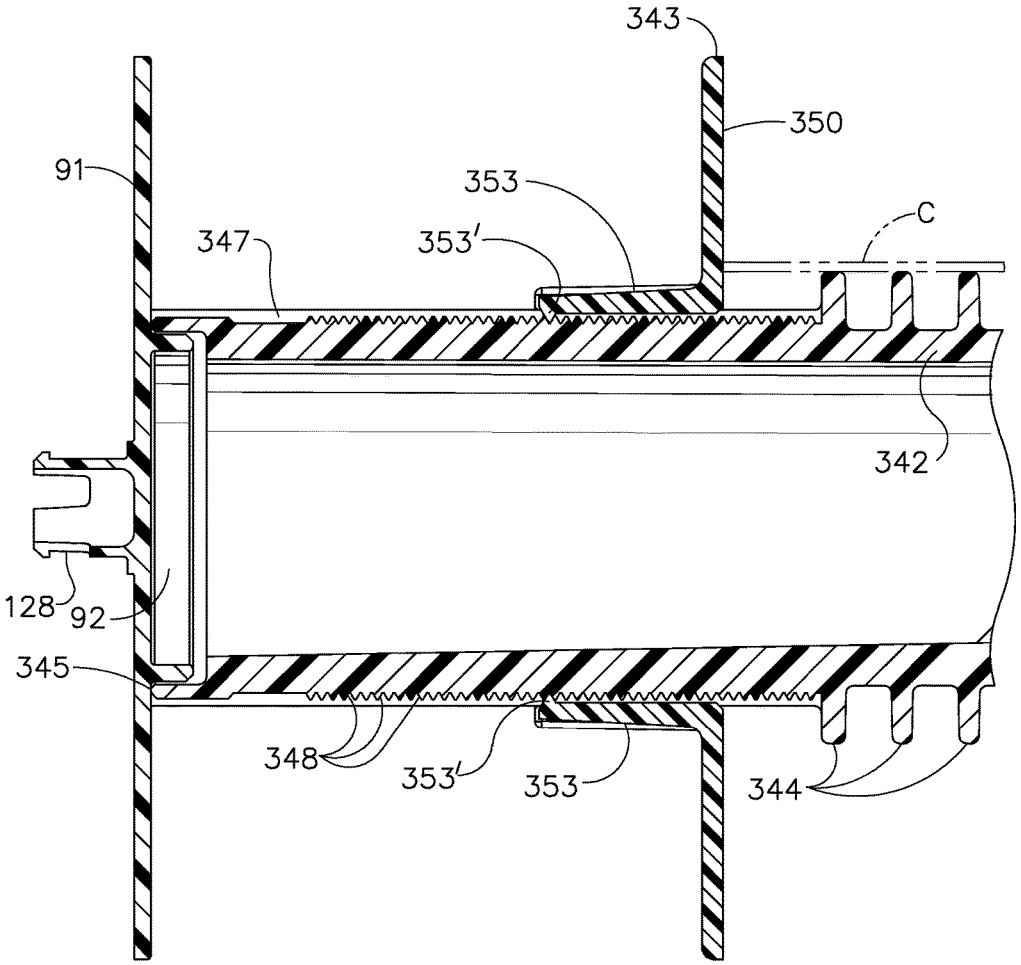
FIG. 36 is an enlarged sectional view of a portion of the guide depicting an alternative way in which side edge guide members may be mounted.

It is to be noted that in the FIG. 36 position, the web C is not supported at its marginal side edges but this is inconsequential because the distances between the endmost guide members 344 and the respective discs 350 is small. In either of the orientations of the side guides 343 as in FIG. 35 or in FIG. 36, the user can space the guides 343 accurately visually or by feeling the graduations 349.

The entire printer is composed of molded plastics material except for the peel roller 69, the guide 79, shafts 94, 105 and 111, springs 149, 199 and 286 bearings 119, 119' 120 and 120', the display 60, the print head 67, the heat sink 67', the motor 242 the clutch 245 and its gear 244, the batteries 80', contacts, electronics and various screws. The brake 212 and the outer part of the platen roll 68 are comprised of resilient elastomeric material, as are all the bumpers 52', 55, 56, 57 and 58.

While the housing sections 52, 53 and 54 are sometimes referred to respectively as first, second and third housing sections, there is no intention to thereby limit the invention, or signify importance of one housing section over any other housing section.

Other embodiments and modifications of the invention will suggest themselves to those skilled in the art, and all such of these as come within the spirit of this invention are included within its scope as best defined by the appended claims.

We claim:

1. A printer, comprising:

A housing having at least a pair of exit openings readily accessible from outside of the printer, and a pair of front bumpers and a pair of rear bumpers disposed at top corners of the housing and which extend outwardly to contact a surface if the printer falls, and the housing has a door with a lower portion with a converging throat, a support mounted on the housing, a print head mounted on the support and capable of printing on a web of record members, an ink ribbon cartridge received on the support, a label roll holder having at least a pair of holding members that are engageable with a supply roll;

a sensor system mounted on one of the at least a pair of holding members; and a movably mounted guide for the web, the guide being movable between an open position and a closed guiding position, the guide being spring-urged to the open position to enable the ink ribbon cartridge to be received on the support, and the ink ribbon cartridge being engageable with the guide to the move the guide toward the closed position against the spring-urging.

2. A printer as defined in claim 1, wherein the support is pivotally mounted, the guide is pivotally mounted, and a spring connected to the support and the guide in an over center arrangement to urge the support and the guide either to the open position or the closed position depending on the position of the ink ribbon cartridge relative to the guide.

3. A printer as defined in claim 1, wherein the support is movable, wherein the ink ribbon cartridge can cam the support and the guide relatively toward each other.

4. A printer as defined in claim 1, including a spring connected to the support and the guide in an over center arrangement to urged the guide and the support relatively toward each other when the ink ribbon cartridge has moved the guide onto the support.

5. A printer as defined in claim 1, wherein the ink ribbon cartridge can engage a holder to cause the support and the holder to move relatively toward each other.

6. A printer as defined in claim 1, including a spring connected to the support and the holder in an over center arrangement to urge the holder and the support relatively toward each other when the ink ribbon cartridge has moved sufficiently onto the support.

7. A printer as defined in claim 1, where the guide comprises a shaft and a pair of spaced side guide members.

8. A printer as defined in claim 7, where each of the side guide members further include a hub portion received about the shaft.

9. A printer as defined in claim 8, where the shaft further includes at least one enlargement between ends of the shaft, and wherein the web of record members is capable of being guided in relationship with the enlargement(s) and the hub portions.

10. A printer as defined in claim 7, where the shaft further includes grooves.

11. A printer as defined in claim 1, where the bumper has an underside that is, a portion at the inner side of the bumper has two flexible, cantilevered projections and respective flanges.

12. A printer as defined in claim 1, where the bumper comprises a resilient elastomeric material.

13. A printer as defined in claim 1, including a supply stool to mount a roll of ink ribbon.

14. A printer as defined in claim 1, including a take-up spool to mount a roll of spent ink ribbon.

15. A printer as defined in claim 1, including a take-up frame to mount a take-up spool.

16. A printer as defined in claim 1, where the guide members and hub have outside diameters that are the same so that side edges of the web are guided by discs and marginal sides edges.

17. A printer as defined in claim 1, where the entire printer is composed of molded plastics material except for a peel roller, a guide, a shafts(s), a spring(s), a bearing(s), a display, a print head, a heat sink, a motor, a clutch and its gear.

18. A printer as defined in claim 1, including a display and a keypad or keys to control printer functions.

19. A printer as defined in claim 1, where the housing sections are connected by a toggle mechanism and toggle members.

20. A printer as defined in claim 17, where the mechanism has a spaced gripper arms.

21. A printer as defined in claim 17, where the toggle member also has an on-demand sensor which can sense a label.

22. A printer as defined in claim 20, where the gripper arms have teeth.

* * * * *